US007293394B2

(12) United States Patent
Davis

(10) Patent No.: US 7,293,394 B2
(45) Date of Patent: Nov. 13, 2007

(54) BUCKLING OPPOSING SUPPORT FOR I-JOIST

(76) Inventor: John D. Davis, 7633 Raven Hills Dr., Las Vegas, NV (US) 89149

( * ) Notice: Subject to any disclaimer, the term of this patent is extended or adjusted under 35 U.S.C. 154(b) by 0 days.

(21) Appl. No.: 10/410,505

(22) Filed: Apr. 8, 2003

(65) Prior Publication Data

US 2004/0200180 A1 Oct. 14, 2004

(51) Int. Cl.
*E04C 3/12* (2006.01)

(52) U.S. Cl. ..... 52/729.2; 52/729.4; 52/729.5; 52/729.1; 52/650.1; 52/737.2

(58) Field of Classification Search .... 52/729.1–729.5, 52/711, 633, 650.1, 650.3, 656.9, 736.2, 737.2; 403/270, 271, 272, 265
See application file for complete search history.

(56) References Cited

U.S. PATENT DOCUMENTS

| | | | | | |
|---|---|---|---|---|---|
| 2,276,040 | A * | 3/1942 | Hull | 52/377 |
| 3,126,709 | A * | 3/1964 | Dougherty | 405/251 |
| 4,011,660 | A * | 3/1977 | Johnson | 33/379 |
| 4,012,883 | A * | 3/1977 | Muller | 52/729.1 |
| 4,019,301 | A * | 4/1977 | Fox | 52/721.4 |
| 4,034,957 | A * | 7/1977 | Cody | 249/189 |
| 4,081,941 | A * | 4/1978 | Van Ausdall | 52/726.2 |
| 4,129,974 | A * | 12/1978 | Ojalvo | 52/729.1 |
| 4,195,462 | A | 4/1980 | Keller et al. | 52/890 |
| 4,219,980 | A * | 9/1980 | Loyd | 52/309.1 |
| 5,519,977 | A | 5/1996 | Callahan et al. | 52/712 |
| 5,595,363 | A * | 1/1997 | De Leebeeck | 248/72 |
| 5,680,738 | A * | 10/1997 | Allen et al. | 52/729.1 |
| 5,930,966 | A * | 8/1999 | Wood et al. | 52/364 |
| 6,158,189 | A * | 12/2000 | Lau | 52/729.4 |
| 6,237,303 | B1 * | 5/2001 | Allen et al. | 52/729.1 |
| 6,460,310 | B1 | 10/2002 | Ford et al. | 52/729.1 |
| D472,791 | S | 4/2003 | Callahan | |
| D472,792 | S | 4/2003 | Callahan | |
| D472,793 | S * | 4/2003 | Callahan et al. | D8/349 |
| D477,210 | S * | 7/2003 | Callahan et al. | D8/349 |
| 6,584,781 | B2 * | 7/2003 | Bishop et al. | 62/54.1 |
| 6,835,261 | B2 * | 12/2004 | Schmidt | 156/92 |
| 2002/0121066 | A1 | 9/2002 | Callahan et al. | 52/713 |

* cited by examiner

*Primary Examiner*—Jeanette E Chapman
(74) *Attorney, Agent, or Firm*—Johannes Schneeberger

(57) ABSTRACT

A support device is provided for the preferred application of buckling opposing support of an I-joist having an erroneously cut hole in its web portion. The support device may have an approximate U-shape with two substantially parallel bridging structures combined by a structure that combines the bridging structures and provides an alignment reference with the chords. In the case where an erroneously cut hole is identified, the support device may be laterally attached to the I-joist such that both bridging structures flank the erroneously cut hole. Once the bridging structures are attached to the web, the bridging structures define with the remainder of the web a buckling opposing interface. The support structure is preferably monolithically fabricated from sheet metal and scaled in conjunction with dimensional standards of commercially available I-joists.

8 Claims, 21 Drawing Sheets

BUCKLING OPPOSING SUPPORT FOR I-JOIST

FIELD OF INVENTION

The present invention relates to support devices for I-joists. Particularly, the present invention relates to devices for buckling opposing support of an erroneously modified I-joist.

BACKGROUND OF INVENTION

I-beams are well-known profiles designed for carrying static loads with a minimal own weight. An I-beam has a cross section similar to that of a capital "I" with top and bottom chords that are vertically spaced apart by a central web portion. A special type of wooden and/or wood like I-beam is used in architectural constructions. This type of I-beam is known as I-joist. I-joists are described, for example in U.S. Pat. No. 4,195,462 to Keller and U.S. Pat. No. 6,460,310 to Ford et al.

I-joists are configured for carrying maximum loads while keeping their own weight to a minimum. For that purpose, I-joists have top and bottom chords with enlarged cross sections where compressive and tensile stresses are at a maximum. A central web portion connects both chords and keeps them at a distance and in plane with the load direction. The central web is also symmetrically positioned with respect to both chords. Under load the chords tend to deflect in plane with the applied load and consequently in plane with the web. The web is configured to provide sufficient stiffness and strength against the deformation tendency of the chords.

The web has a relatively thin cross-section geometry, which results in a certain buckling tendency of it. The buckling tendency of the web portion is a major criterion for the over all load carrying capacity of an I-joist. The structural integrity of the web is often compromised in architectural constructions. To assure sufficient buckling resistance of the modified web, manufacturers may provide dimensional safety limits for maximum diameter and other critical dimensions for holes cut into the web. Unfortunately, such standards are often not met by the construction workers that are typically in charge of fabricating the holes into the web. In a progressing architectural construction where the I-joist is already hidden from view, it becomes difficult to control the holes cut into the webs. Therefore, there exists a need for assuring the I-joists static load capacities irrespective of the actually hole shape cut into a web. The present invention addresses this need.

Reinforcement brackets for modified structural beams are well-known in the art. For example, U.S. Pat. No. 5,519,977 to Callahan et al (1). describes a reinforcement bracket for modified sections of a wooden joists. The invention is configured for joists with rectangular cross section. Support is mainly provided by configuring the bracket as a profile protruding in direction of the beam and having bending resistance that is maximized in protrusion direction of the joist. An eventually increased buckling tendency of the modified joist is not addressed by the invention. More over, the bracket attached at the modified joist offsets the all over section modulus of the combined cross section of joist and bracket out of the load plane. As an unfavorable result, a modified joist section supported by Callahan's bracket may have a greater buckling tendency than the same modified joist section not supported by Callahan's bracket.

Another example for a reinforcement bracket is described in U.S. patent application Publication 2002/0121066 also to Callahan et al (2). There, the bracket of the above-described invention is modified to accommodate for material separations cut through the top chord of an I-joist. In general, the applicability of this device may be limited since material separations of the chords are highly questionable due to their tremendous negative effect on the joist's load carrying capacity. As is well-known in the art and dependent on the load carrying condition, building codes strictly mandate that transverse holes bored or cut into a joist must remain at a certain distance from the top or bottom of the joist. For an I-joist in particular, it is recommended by manufacturers to avoid cutting either of the cords of a load carrying I-joist section. In addition, the buckling increasing effect of the bracket becomes even more dominant where the remaining cross section of the modified I-joist is much thinner than the rectangular section of a conventional modified joist.

Also, in Callahan et al (2) the connection between the bracket and the I-joist relies substantially on screws or nails laterally attached to the remainder of the chords. Chords that are fabricated from vertically stacked, laminated wood are highly sensible to splicing initiated by horizontally attached nails or screws. Attaching a support device on the chords for the purpose of transmitting bending loads from the I-joist onto the bracket consequently may result in splicing of the chords. The splicing of the chords results in a further weakening of the modified I-joist section. The splicing also reduces the rigidity of connection between the bracket and the modified I-joist section. Therefore, there exists a need for a support structure that may be attached to a modified I-joist with reduced and/or without laterally attaching to the chord (s). The present invention addresses this need.

SUMMARY

A support device for an I-joist provides primarily buckling opposing support to the remaining web portions adjacent a hole erroneously cut into the I-joist's web. The buckling opposing support is established by bridging structures that protrude between and span across the top and bottom chords of the I-joist. The bridging structures are configured to provide a maximum bending resistance in a direction between the chords.

The support device is configured for a lateral attachment to an I-joist. The support device may be scaled and prefabricated in a number of configurations that correspond to dimensional standards of I-joists. Hence, by selecting a support device in a scale that corresponds to a dimensional standard of an I-joist at hand, a construction worker may easily repair an erroneously cut hole and or reinforce an I-joist's web portion by simply attaching the support device at an appropriate location.

In the preferred embodiment, the support device has an approximate U-shape such that it may be attached to the I-joist in a progressed construction assembly where other profile(s) is/are already assembled through the cut web hole.

The support device is preferably made of sheet metal and provides holes for readily attaching it to the web portion by nailing, screwing or other well-known fastening techniques feasible for attaching a sheet metal part to a wooden or wood like material. The support device further provides secondary holes for an eventual secondary attachment to the chord(s) for the purpose of adding rigidity to the assembled support device. Additional stiffening features may be part of the support device to either increase the device's stiffness against the web portions buckling tendency and/or to increase an interlocking and/or snuggly fit between the device and the I-joist. The bridging structures may further operate to transmit compressive forced eventually occurring between the chords as a result from the I-joists deflection. In that way, the buckling tendency of the web portion may be additionally opposed.

The support device is configured for attachment and operation without substantially reducing the structural integrity and stress absorbing capability of the chords. Eventual attaching of the support device is provided in a fashion that keeps the chords' splicing tendency to a minimum.

BRIEF DESCRIPTION OF THE FIGURES

FIG. 1 shows an exemplary section view of a prior art assembly of I-joists with a profile assembled in between.

FIG. 3 illustrates an I-joist section with a support device in accordance with a first embodiment of the invention and a support structure attached in between.

In FIG. 9A, only a bottom portion of the I-joist is shown with the web portion broken apart to free the view onto the entire support device.

In FIG. 10A, only a bottom portion of the I-joist is shown with the web portion broken apart to free the view onto the entire support device.

DETAILED DESCRIPTION

Figure 1:
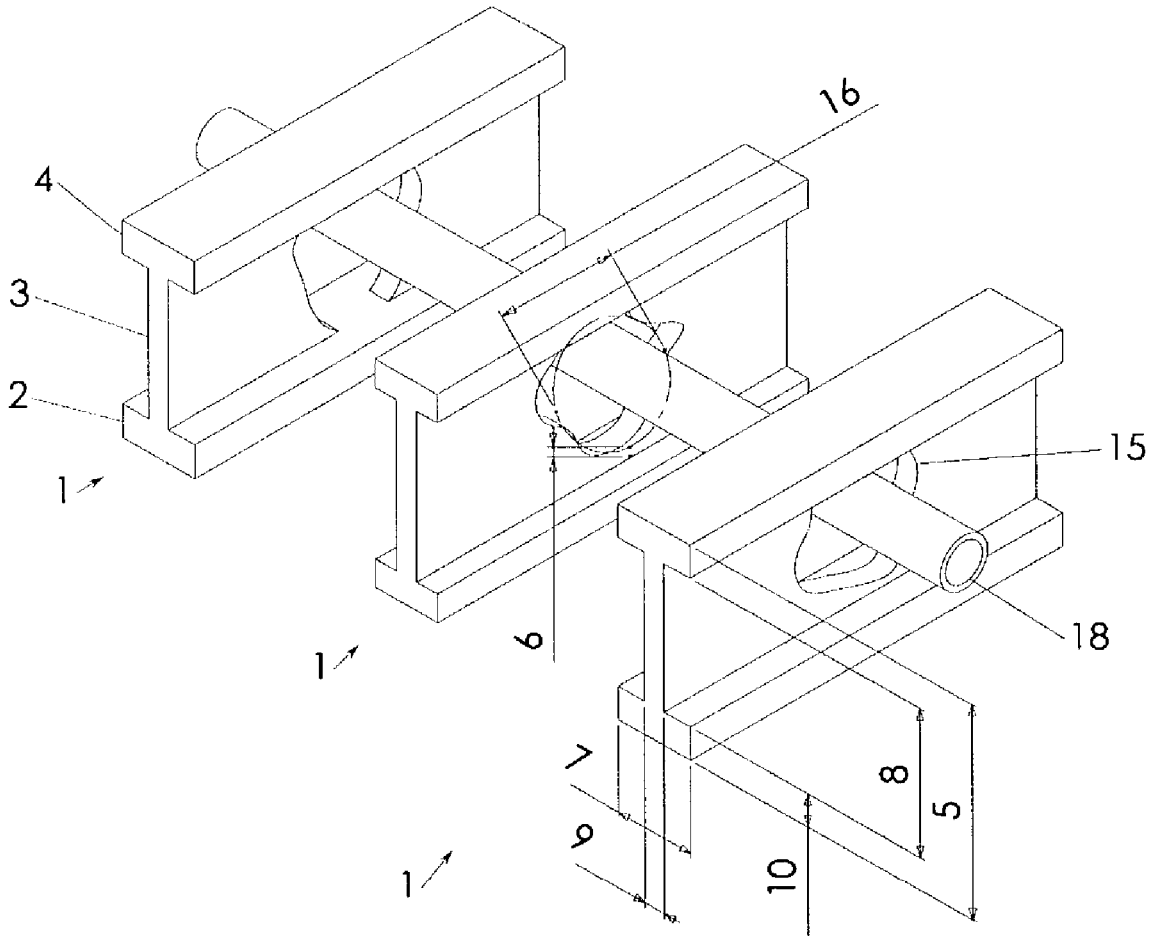
Prior Art Fig. 1

Prior art FIG. 1 shows exemplary sections of I-joists 1 assembled as it may occur in architectural constructions. There, holes 15 may be cut into the I-joists' 1 central web portions 3 such that a profile 18 may be installed in between the top chord 4 and the bottom chord 2 in directions other than parallel to the I-joists 1. The profile 18 may be an electrical line, a plumbing pipe or the like.

To reduce a buckling tendency of the modified I-joist 1, manufacturers provide dimensional safety limits for holes 15 cut into I-joist 1. These safety limits may not be met by the construction workers, which are typically in charge of fabricating the holes 15 at the construction site. A buckling tendency of the web 3 may become unpredictable and excessive where the hole 15 exceeds the safety limits.

With respect to the present invention, the I-joists 1 are I-shaped profiles made from wooden and/or wood like material. I-joists 1 may be provided by manufacturers in a number of dimensional standards, which include a chord width 7, a total height 5, a chord height 10, a web thickness 9 and web height 8. I-joists may be preferably symmetric with respect to a horizontal and a vertical center plane of the I-joist 1 as is well appreciated by anyone skilled in the art. The symmetric shape provides for a symmetric section modulus that keeps a buckling tendency to a minimum in unmodified condition of the I-joists 1 in general and the web 3 in particular.

Additional elements like, for example a profile 18 may extend through the web portions 3 of adjacent I-joists 1. The exemplary profile 18 may be an electrical line, a plumbing or the like. To install the profile 18 at the construction site, holes 15 are cut into the I-joists 1.

Holes 15 may be cut in accordance with maximum safety dimensions established by manufacturers for their respective I-joist products. The maximum safety dimensions may include a maximum allowable hole diameter 16 and a minimum remaining web height 6 adjacent the top cord 4 and/or the bottom chord 2. The maximum safety dimensions are exemplary illustrated as a dot dashed line.

Figure 2:
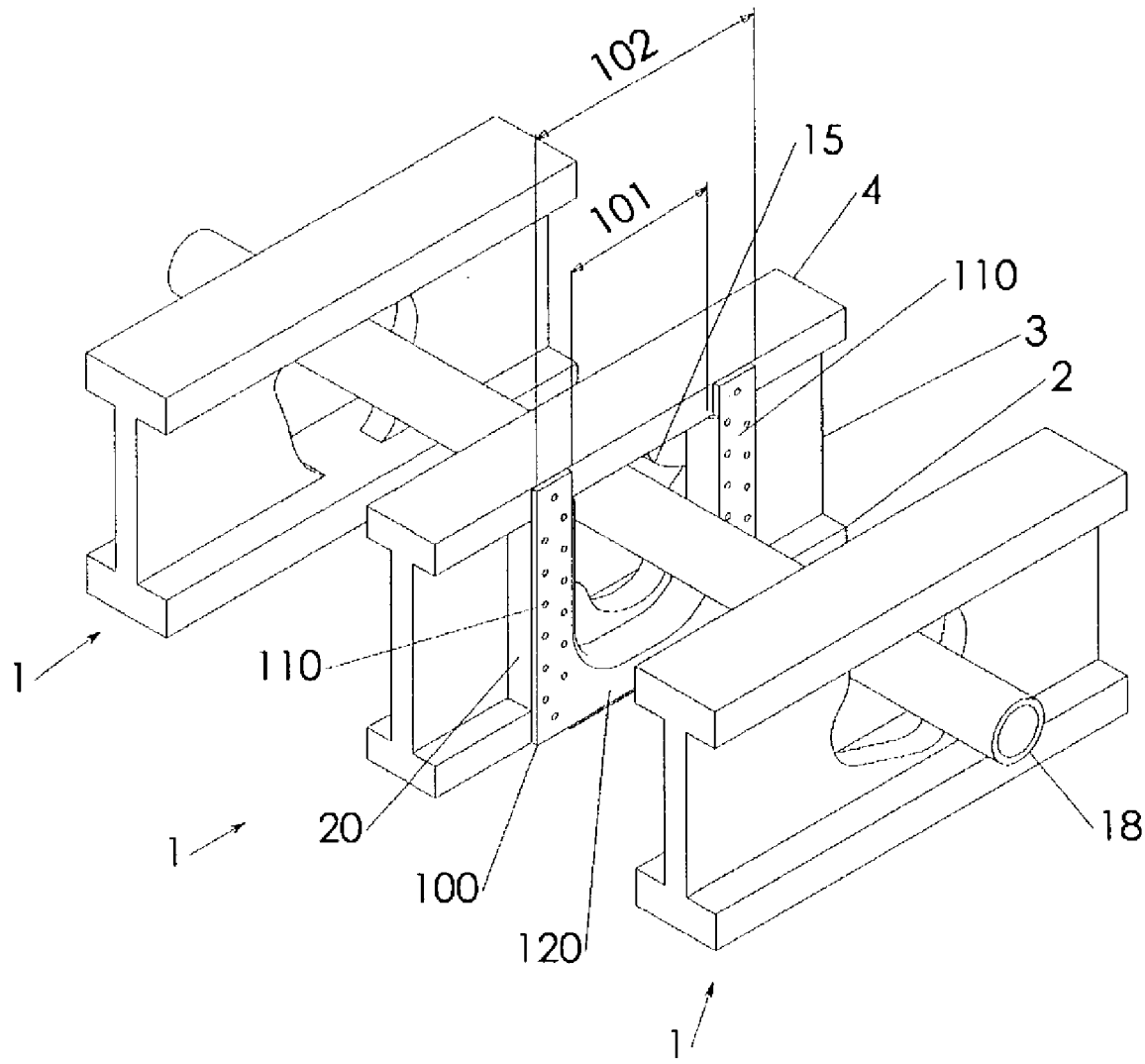
FIG. 2 depicts the exemplary section view of FIG. 1 with a support device in accordance with a first embodiment of the present invention attached at a central I-joist.

Holes 15 may exceed the maximum safety dimensions, which results in an unpredictable buckling tendency of the remaining web portion 3 adjacent the erroneously cut hole 15. As illustrated in FIG. 2, a support device 100 may be laterally attached to the I-joist 1 having an erroneously cut hole 15. The support device 100 is primarily attached to the web portion 3 via an additional support structure 20.

The support device 100 provides bridging structures 110 that spans across the web height 8 with its central portion. The bridging structures 110 establish with their central portion a buckling opposing interface with the web 3 once attached to the web 3. By placing a bridging structure 110 of the first embodiment immediately adjacent the erroneously cut hole 15 and combining it with the additional support structure 20, the unpredictable buckling tendency of the I-joist 1 in the vicinity of the erroneously cut hole 15 is brought within predictable limits.

In the context of the present invention the terms "top", "bottom", "horizontal", "vertical" are introduced in reference to an assembly position of the support device 100 on an I-joist 1 in a conventional assembly position with one chord above the other, where the I-joist 1 may have its maximum load carrying capacity.

A buckling opposing interface is-defined by contacting the remainder of the web 3 with the central portion of the bridging structure 110 that is provided with a bending stiffness at a level such that the buckling tendency of the remaining web 3 is kept equal or below to a reference buckling value associated with the maximum safety dimensions. The buckling opposing interface may be preferably established by fastening the central portion to the remaining web 3.

The support device 100 is scaled in conjunction with the dimensional standards of the I-joists 1. Hence, by merely selecting the properly scaled support device 100, a hole 15 erroneously cut in any standard I-joist 1 may be easily repaired.

The erroneously cut hole 15 is preferably flanked on both sides by a bridging structure 110. To accommodate for the preferred dual application of two flanking bridging structures 110, the present invention has a preferred configuration as an approximately U-shaped device in which two bridging structures 110 are combined by a chord embedding structure 120. The chord embedding structure 120 is configured to snuggly fit over a lateral portion of preferably one of the chords 2, 4. In that way, the support device 100 may be easily brought into assembly position by pushing the cord embedding structure 120 onto one of the chords 2, 4. The support device's 100 U-shape provides for an access to the assembly location regardless the eventual presence of profile 18 protruding through the I-joists 1.

The scope of the invention is not limited to a particular number, orientation and/or spacing of the bridging structures 110 to each other. Nevertheless, in the preferred embodiment of the invention, the bridging structures 110 are preferably parallel to each other and are substantially perpendicular oriented with respect to the chord embedding structure 120. Thus, once the support device 100 is attached to the I-joist 1, the bridging structures 110 are substantially perpendicular to the protrusion direction of the I-joist 1. As another result, a low overall width 102 of the support device 100 is assured for a given clearance distance 101. The clearance distance 101 may be selected in accordance with the maximum allowable hole diameter 16.

Figure 3:
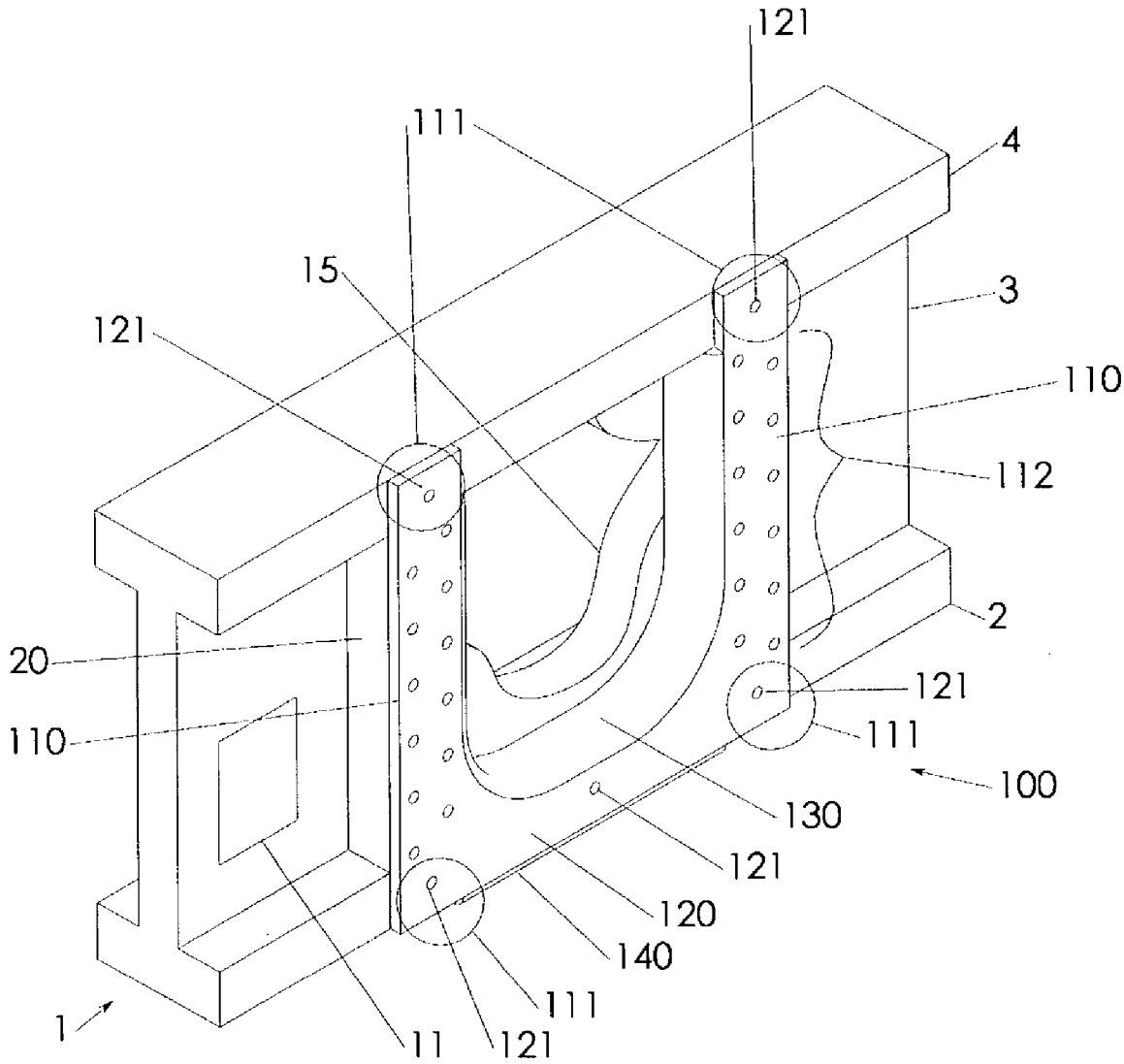

In the first, second, third and fourth embodiments of the invention described in the above and the below and as is shown in FIG. 3, each bridging structure 110 is a profile that extends substantially perpendicular to the I-joist's 1 protrusion direction in assembly position. End portions 111 of the bridging structures 110 continue and extend across the lateral portions of the chords 2, 4. The end portions 111 may be attached to the chords 2, 4 via secondary holes 121 primarily for the purpose of adding rigidity to the assembled support device 100. Particularly, the secondary holes 121 may be configured in size and number to keep a splicing risk of the chords 2, 4 to a minimum.

The central portion of the bridging structures 110 feature primary attachment holes 112. Holes 112, 121 are configured for receiving fasteners well known for architectural constructions. Such fasteners may include but are not limited to nails, screws and the like. The holes may be substituted by indentations such that a nail or screw is initially forced through solid material of the support device 100.

In the first embodiment, the bridging structure 110 is configured for including an additional support structure 20 in the buckling opposing interface. The primary holes 112 serve thereby for attaching the central portion to the support structure 20 via well known fasteners such as nails, screws and the like. The support structure 20 may be a piece of rectangular wood with a cross section corresponding to a gap between the central bridge portion and the web 3.

The support device 100 is preferably made of sheet metal, which assures minimum increase of the I-joist's 1 overall width 7. As a primary means for stiffening the support device 100, a first stiffening rib 130 is provided along the inside contour of the support device 100. The first stiffening rib 130 protrudes substantially perpendicular with respect to a reference plane 11. The reference plane 11 is substantially parallel to the main planar body of the support device 100 in assembly position. The reference plane 11 is defined by correspondingly opposing lateral edges of the chords 2, 4 at the same side of the I-joist 1. In context with the present invention, the term side of the I-joist 1 refers to either a left or a right side of the I-joist 1 in the protrusion direction of the I-joist 1 and with the I-joist 1 being oriented with the chord 4 being on top of the chord 2.

The main planar body is a substantially flat portion of the support device 100 including the flat portion of the bridging structures 110 and the flat portion of the chord embedding structure 120. The first stiffening rib 130 has a height that corresponds to the half of the difference between chord width 7 and web thickness 9 such that the top edge of the first stiffening rib 130 snuggly contacts the web 3 when the support device 100 is attached to the I-joist 1. A horizontal portion of the first stiffening rib 130 is positioned on the support device 100 such that in assembled position of the support device 100 the first rib's 130 horizontal portion contacts a lateral portion of one of the chords 2, 4 inside the I-joist 1.

Figure 4:
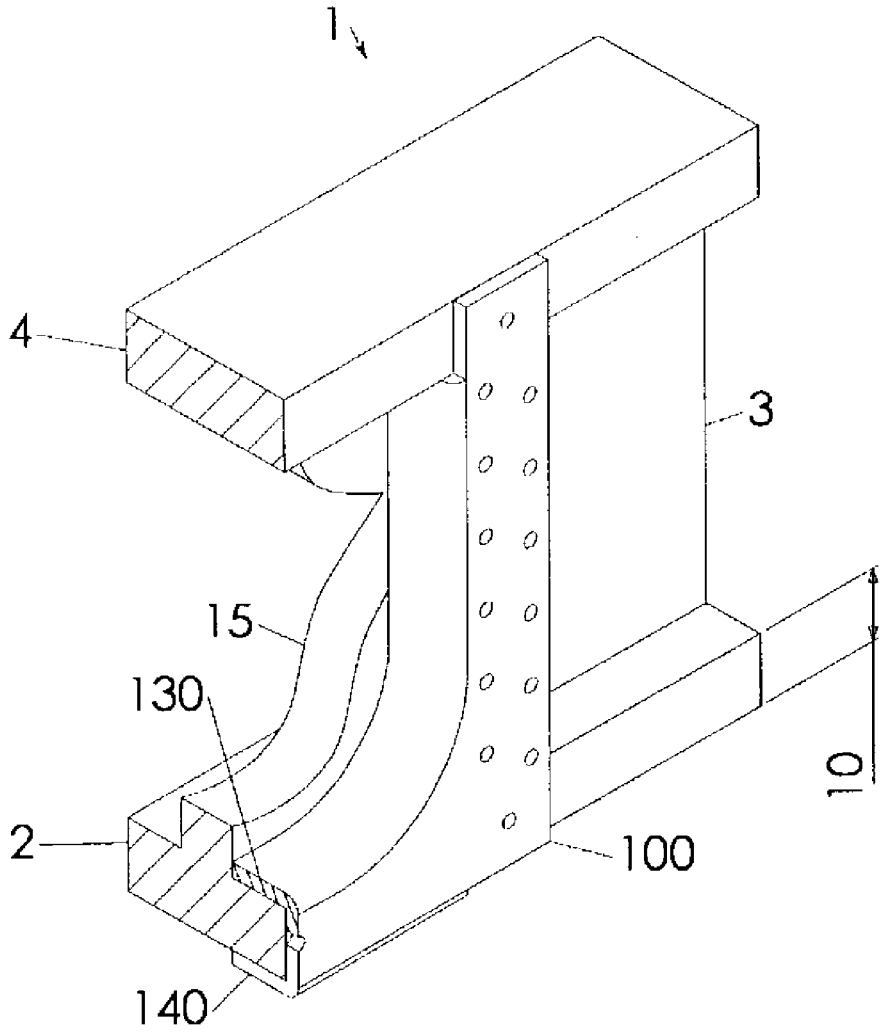
FIG. 4 shows a section view of FIG. 3 along a vertical plane approximately through a center of the support device.
Figure 5:
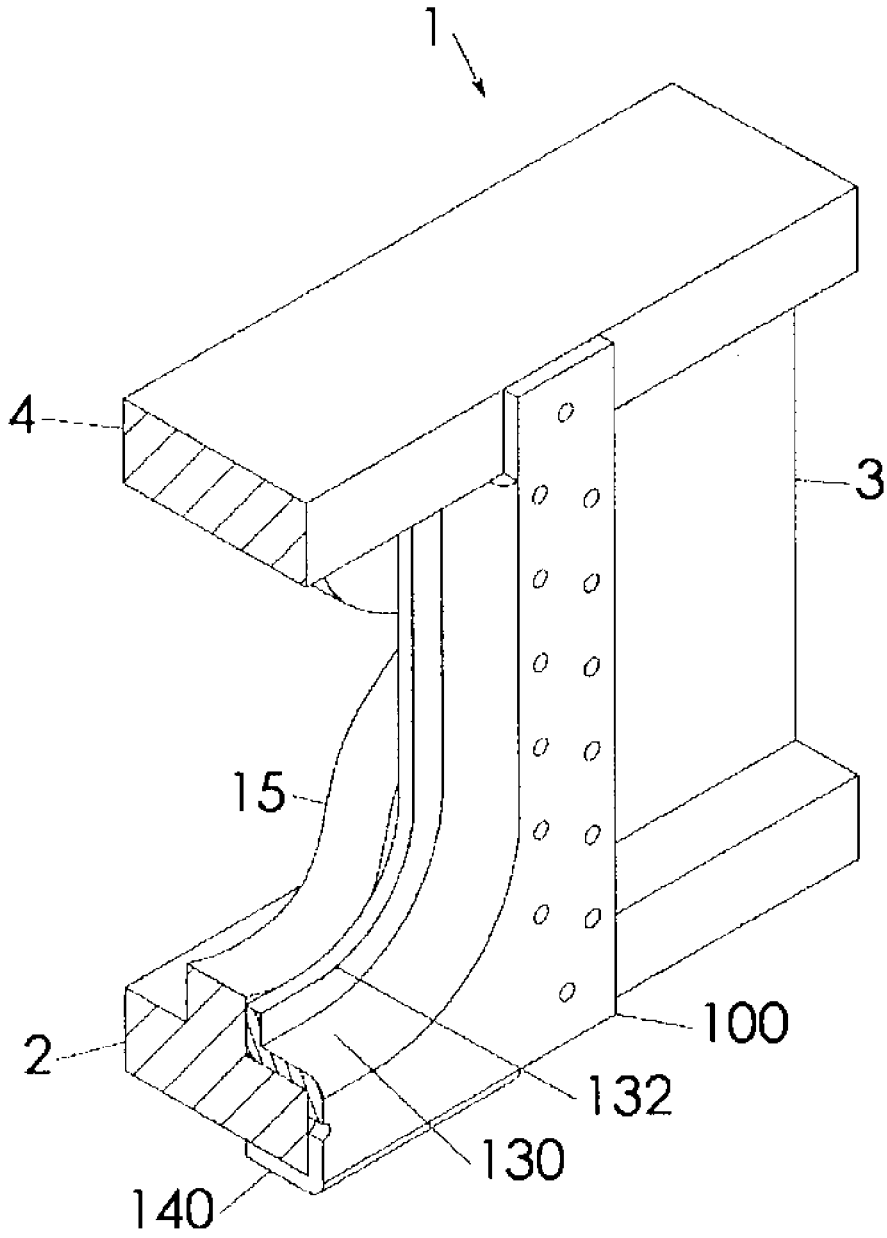
FIG. 5 shows a vertical central section view of an I-joist and a support device in accordance with a second embodiment of the invention.

As shown in FIGS. 4 and 5, the support device 100 may also feature a second stiffening rib 140 that protrudes in direction substantially parallel to the first stiffening rib 130 from the bottom edge of the chord embedding structure 120. The second stiffening rib 140 and the horizontal portion of the first stiffening rib 130 are in a distance substantially equal to the chord height 10. The second stiffening rib 130 is positioned on the support device 100 such that in assembled position of the support device 100 the second stiffening rib 140 contacts the lateral portion of one of the chords 2, 4 outside the I-joist 1.

Figure 11A:
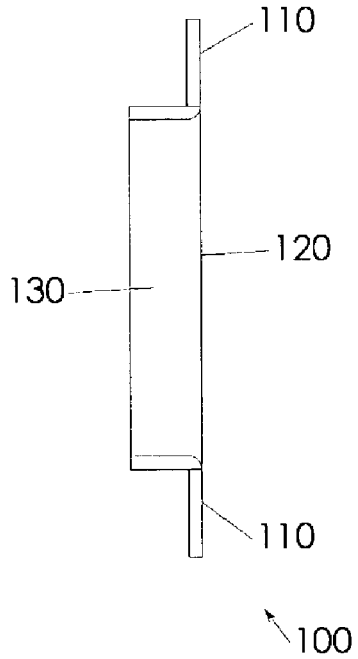
FIGS. 11A–11D illustrate various views of the support device in accordance with the first embodiment of the invention.
Figure 11B:
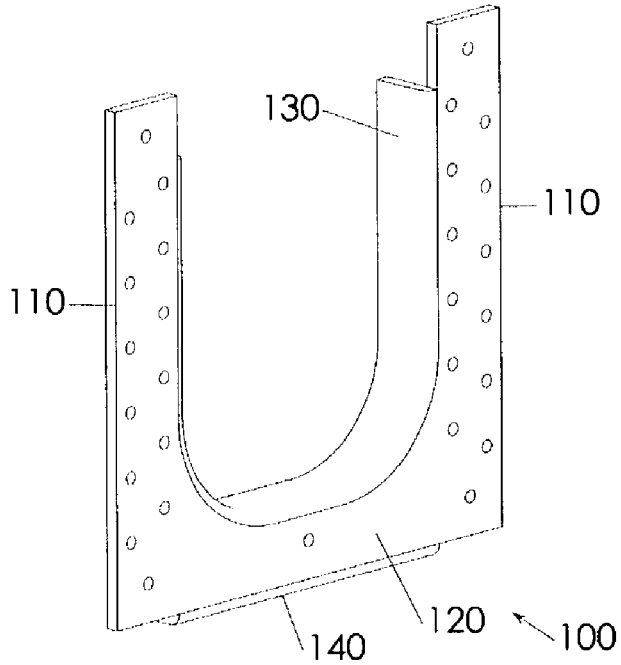
Figure 11C:
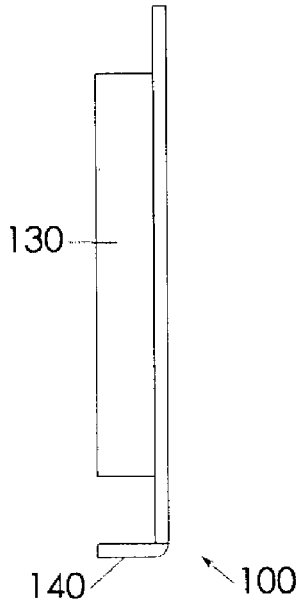
Figure 11D:
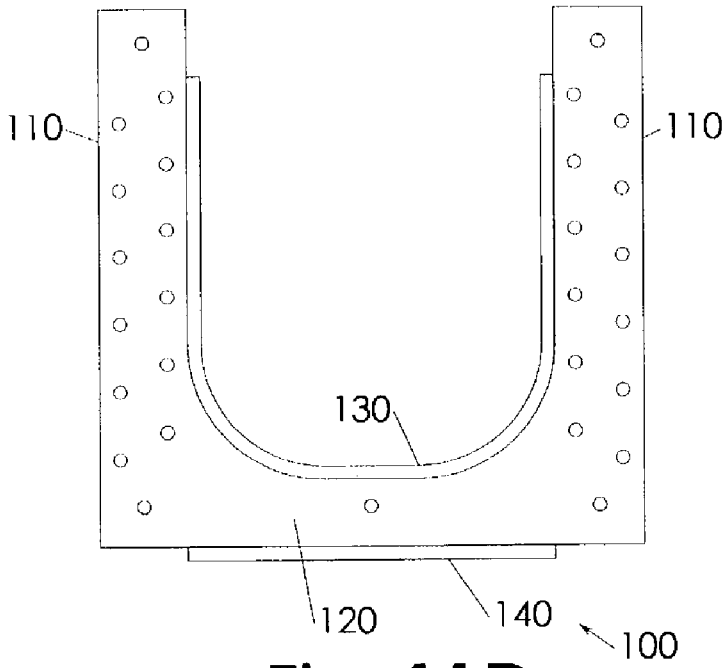

The first rib's 130 horizontal portion and the second rib 140 provide for an intermediate reliable positioning of the support device 100 in its final assembly position such that the support device 100 may be temporarily held in assembly position by merely pushing the support device 100 with its chord embedding structure 120 over a lateral portion of a chord 2 or 4. This is particularly advantageous where the support device 100 needs to be assembled at locations that are difficult to access by a construction worker. A support device 100 in accordance with the first embodiment is shown in top view in FIG. 11A, in perspective view in FIG. 11B, in side view in protrusion direction of the I-joist 1 in FIG. 11, and in FIG. 11D in front view, which is in direction of the reference plane 11.

Figure 12A:
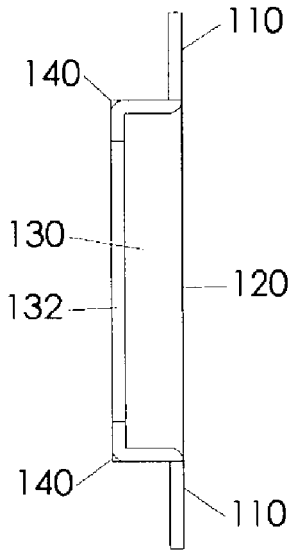
FIGS. 12A–12D illustrate various views of the support device in accordance with the second embodiment of the invention.
Figure 12B:
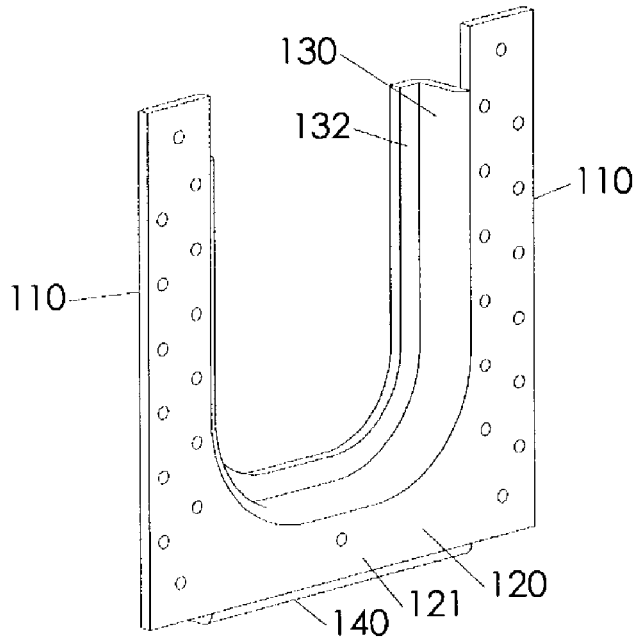
Figure 12C:
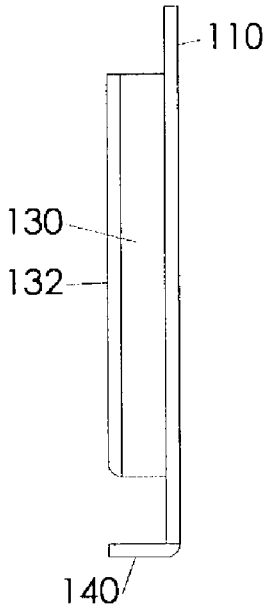
Figure 12D:
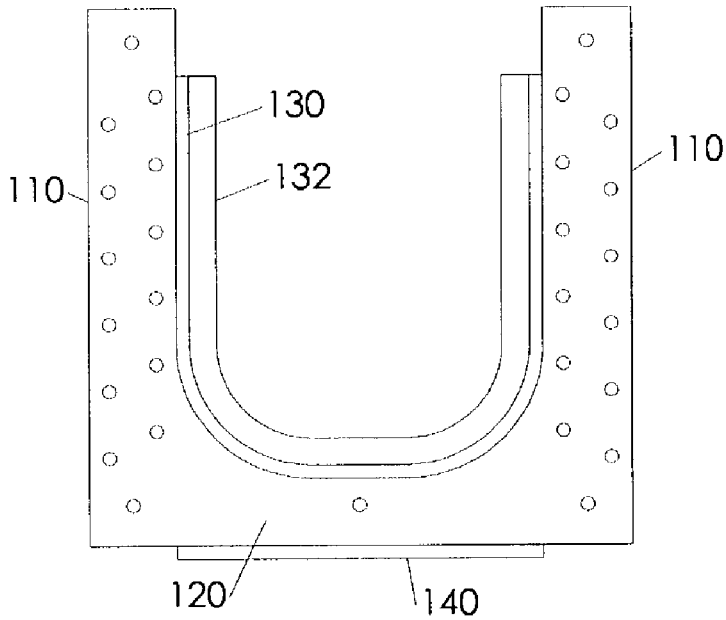

In FIG. 5, a second embodiment is illustrated in which the first stiffening rib 130 features a first flange 132, which on one hand increases the stiffness of the first stiffening rib 130 and on the other hand provides for an area contact between the first stiffening rib 130 and the web 3. A support device 100 in accordance with the second embodiment is shown in top view in FIG. 12A, in perspective view in FIG. 12B, in side view which is in protrusion direction of the I-joist 1 in FIG. 12C, and in FIG. 12D in front view, which is in direction of the reference plane 11.

Figure 6:
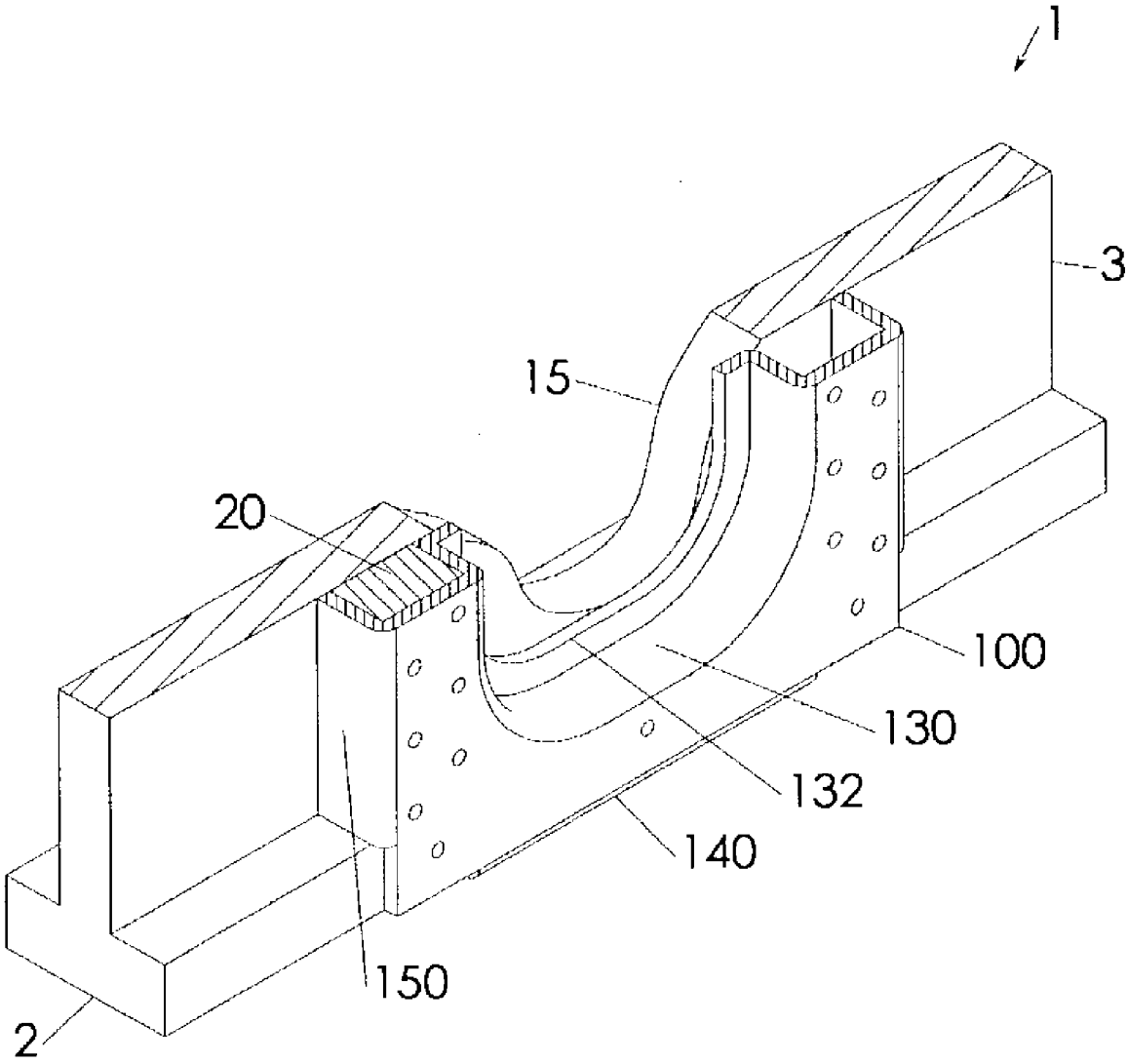
FIG. 6 depicts a horizontal central section view of an I-joist, the support structure of FIG. 3 and a support device in accordance with a third embodiment of the invention.
Figure 13A:
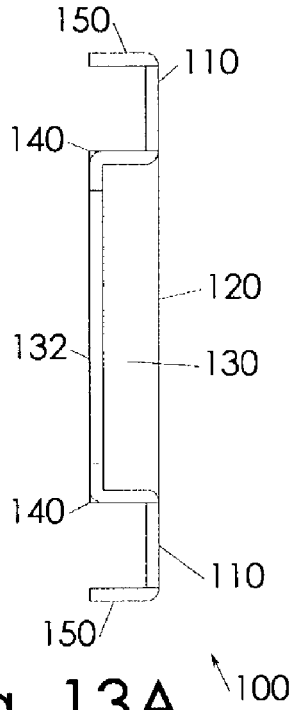
FIGS. 13A–13D illustrate various views of the support device in accordance with the third embodiment of the invention.
Figure 13B:
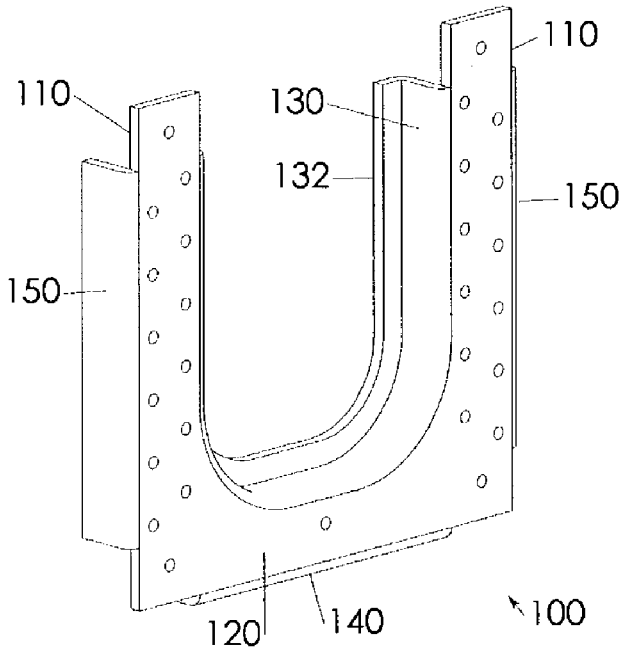
Figure 13C:
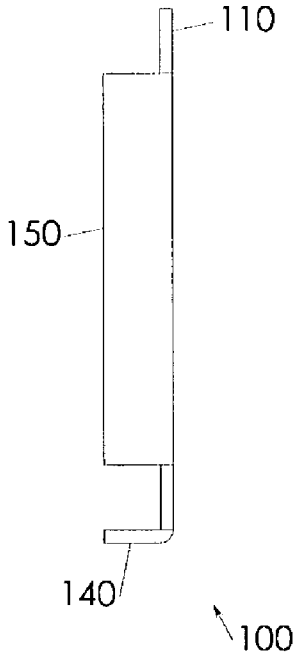
Figure 13D:
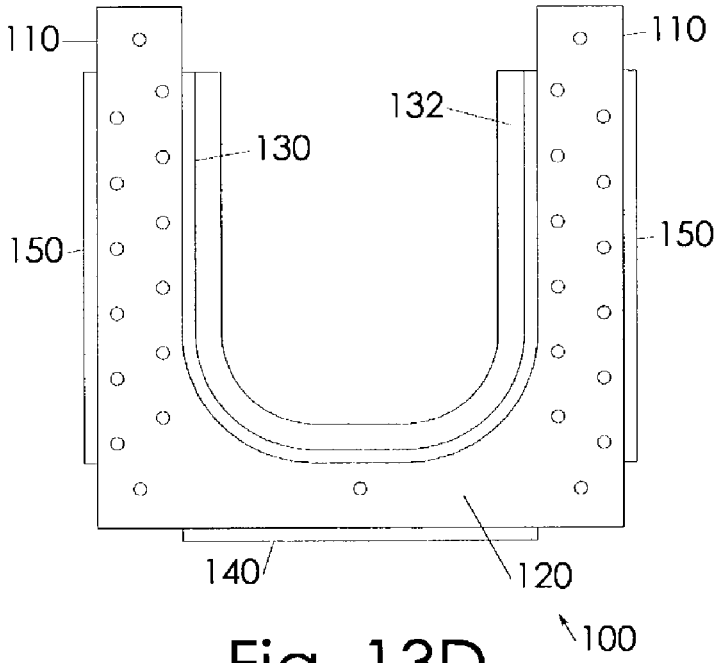

In FIG. 6, a third of the preferred embodiments is illustrated, in which third stiffening ribs 150 protrude from the outer edge of one or both of the bridging structures 110. The third stiffening ribs 150 protrude in direction substantially parallel to the first stiffening rib 130 and may be of substantially equal height as the first stiffening rib 130. The third stiffening ribs 150 provide additional bending stiffness to the central portion of the bridging structures 110. The third stiffening ribs 150 may be in a distance to a vertical portion of the first stiffening rib 130 such that the support structure 20 may be snuggly held between them. This may additionally ease the assembly process, since the support structure 20 may be brought into position relative to the support device 100 prior to assembly of the support device 100 itself. A support device 100 in accordance with the third embodiment is shown in top view in FIG. 13A, in perspective view in FIG. 13B, in side view which is in protrusion direction of the I-joist 1 in FIG. 13C, and in FIG. 13D in front view, which is in direction of the reference plane 11.

Figure 7:
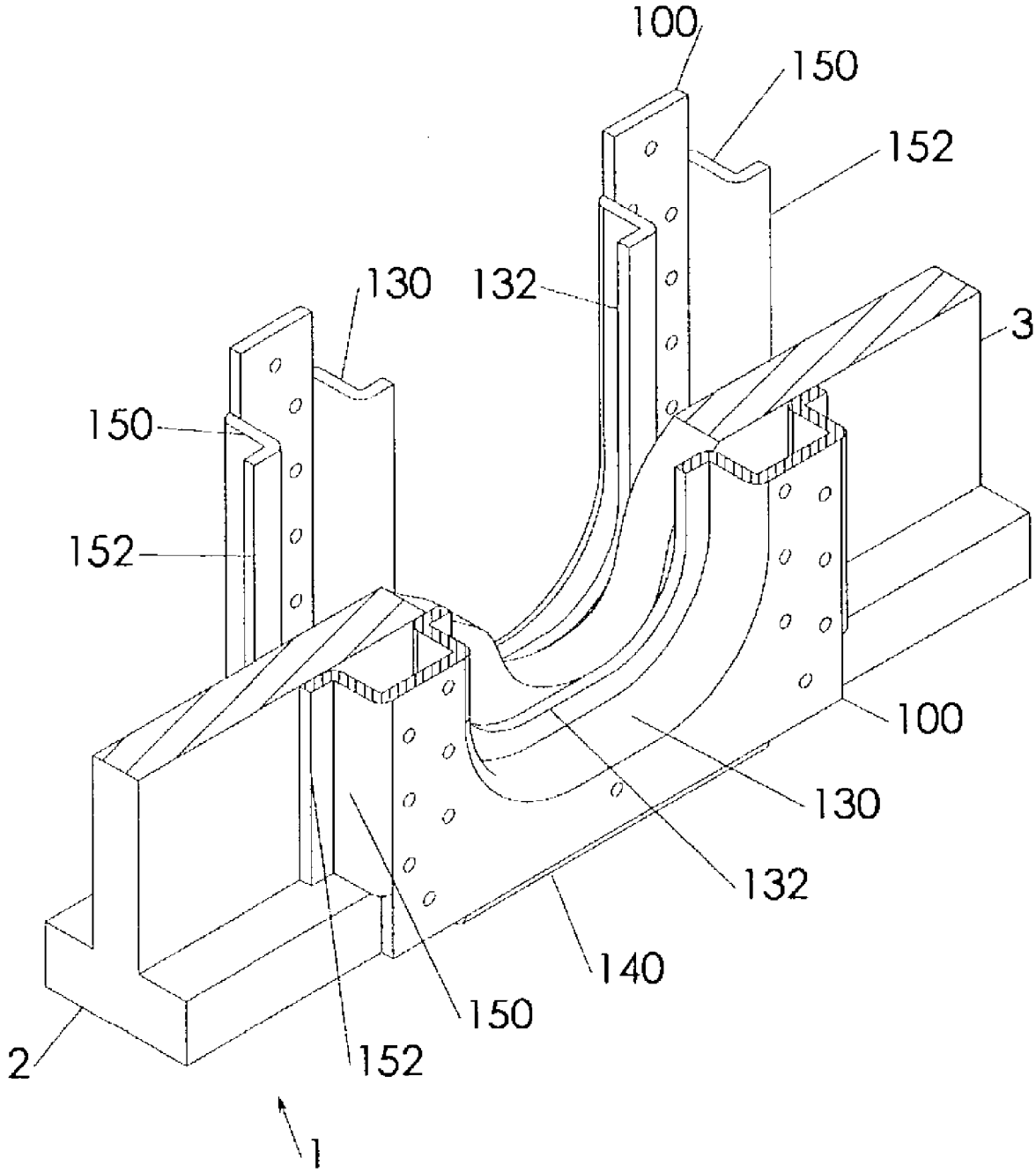
FIG. 7 depicts a horizontal section view of an I-joist and a first support device in accordance with a fourth embodiment of the invention. A second support device in accordance with the fourth embodiment is shown in attachment position opposing the first support device.
Figure 14A:
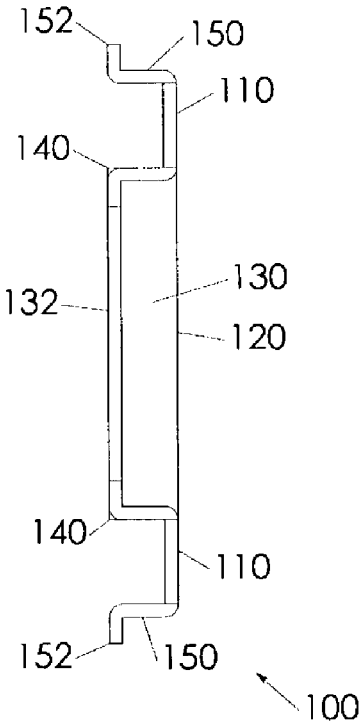
FIGS. 14A–14D illustrate various views of the support device in accordance with the fourth embodiment of the invention.
Figure 14B:
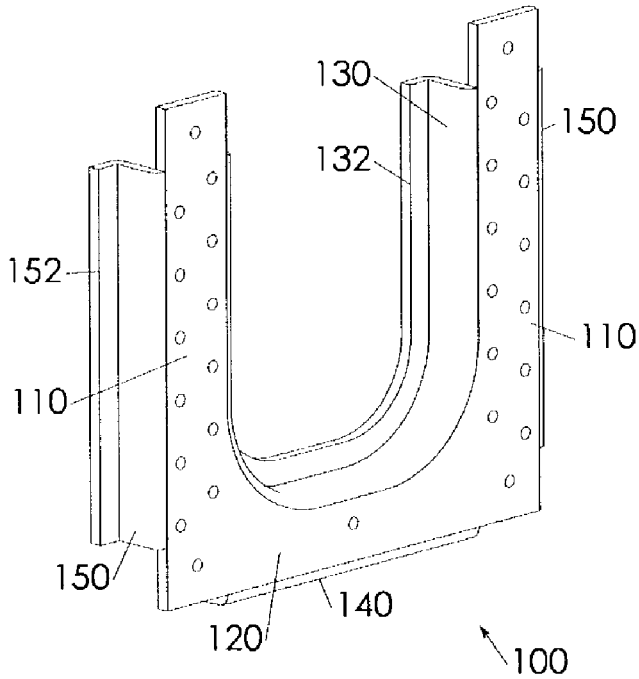
Figure 14C:
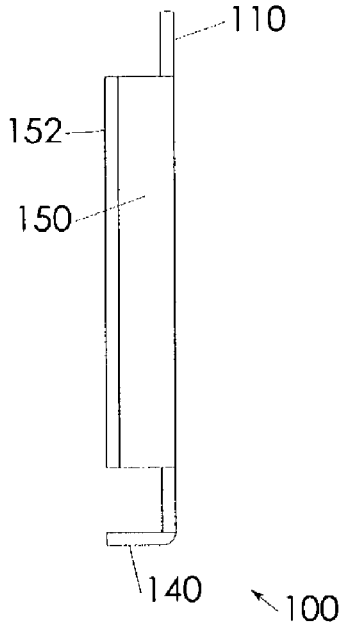
Figure 14D:
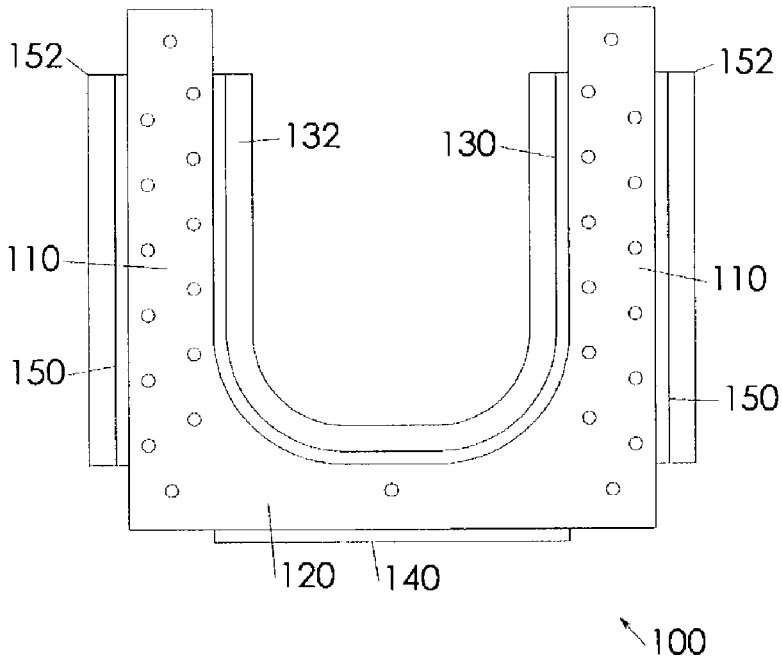
Figure 15A:
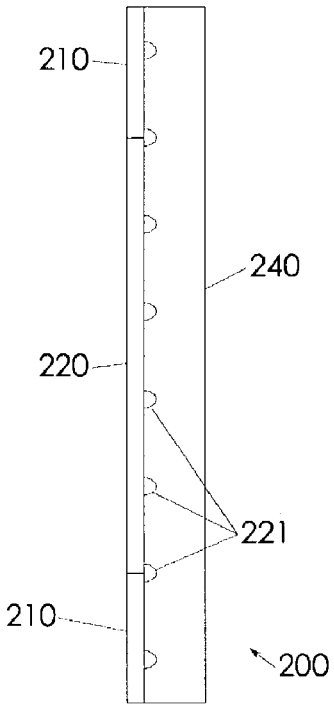
FIGS. 15A–15D illustrate various views of the support device in accordance with the fifth embodiment of the invention.
Figure 15B:
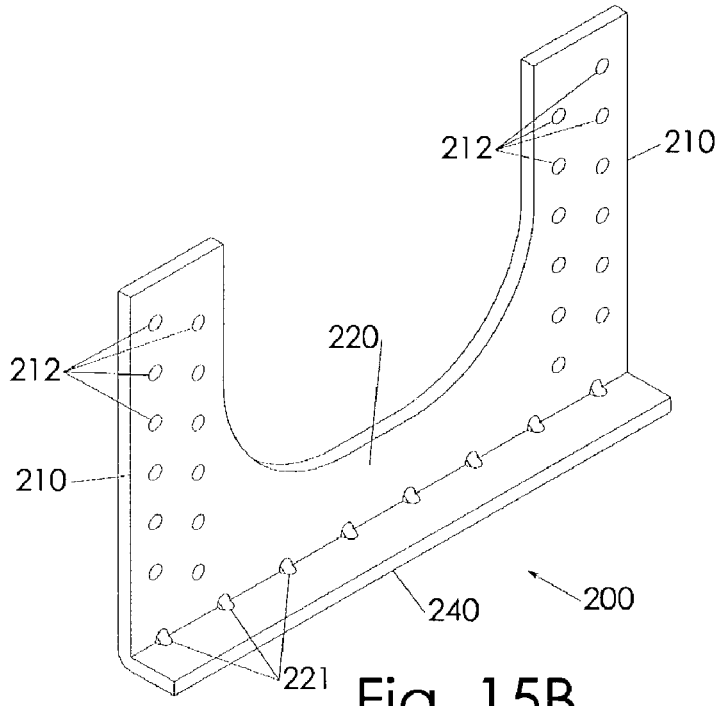
Figure 15C:
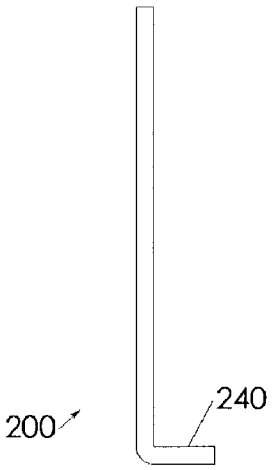
Figure 15D:
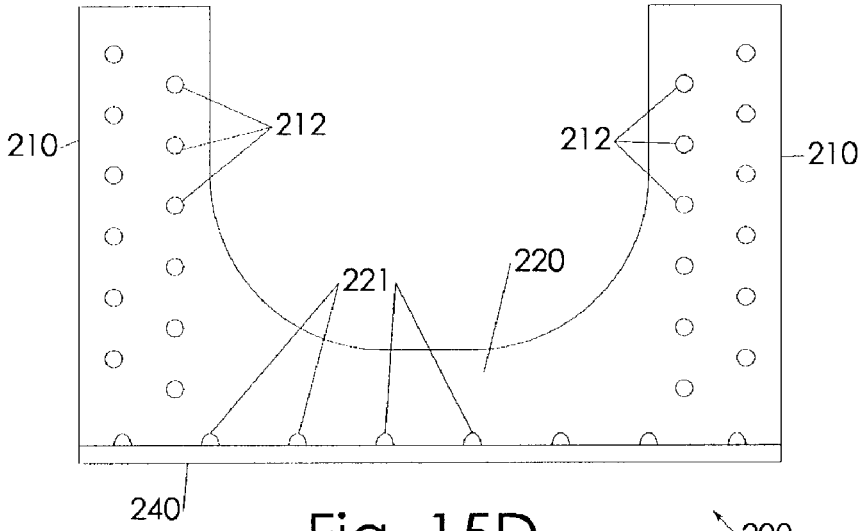
Figure 16A:
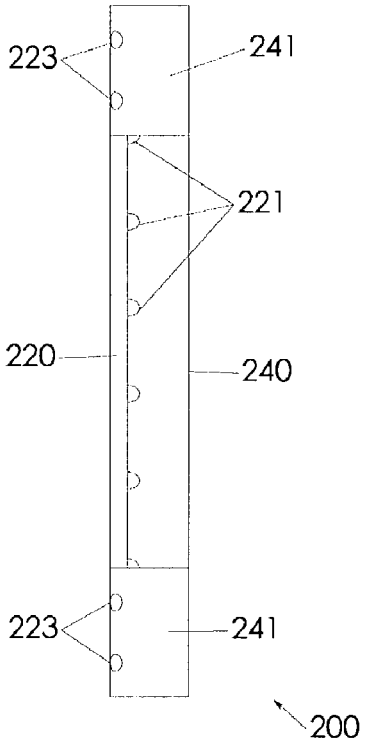
FIGS. 16A–16D illustrate various views of the support device in accordance with the sixth embodiment of the invention.
Figure 16B:
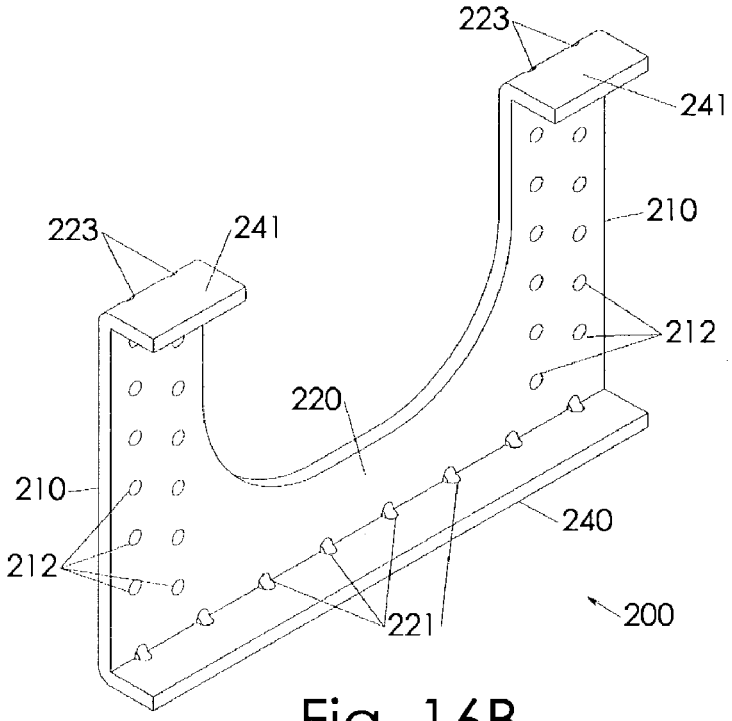
Figure 16C:
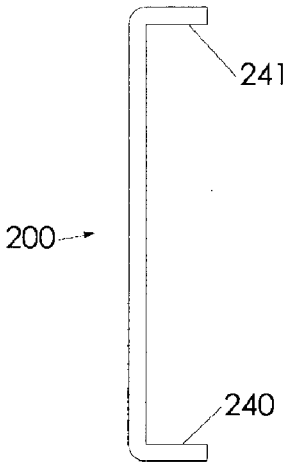
Figure 16D:
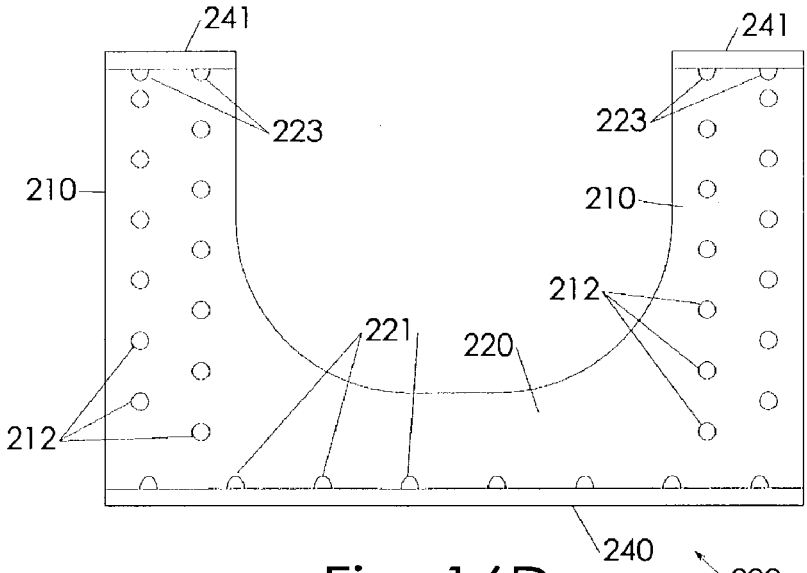
Figure 17A:
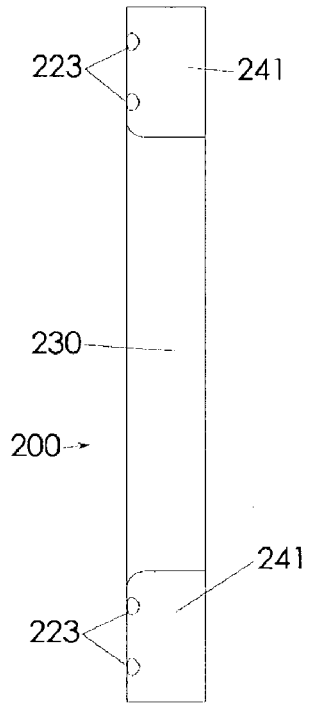
FIGS. 17A–17D illustrate various views of the support device in accordance with the seventh embodiment of the invention.
Figure 17B:
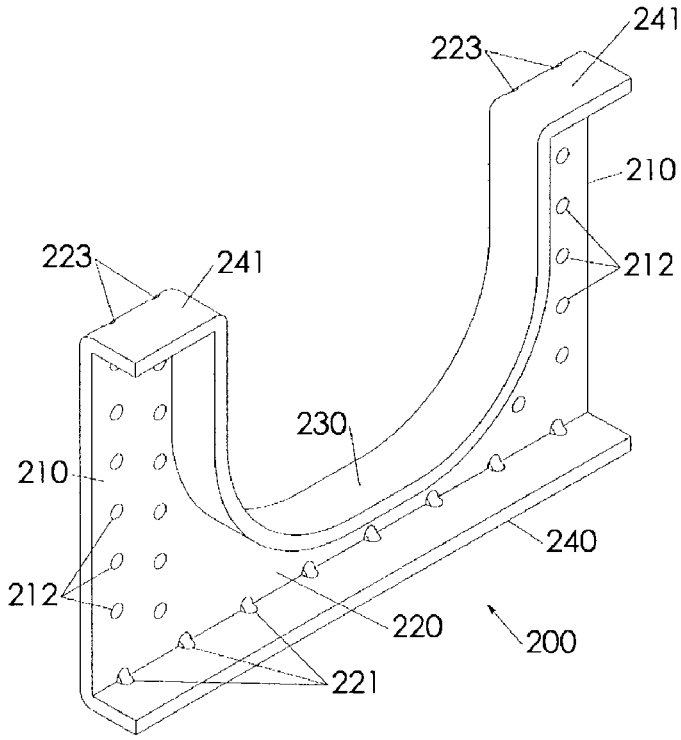
Figure 17C:
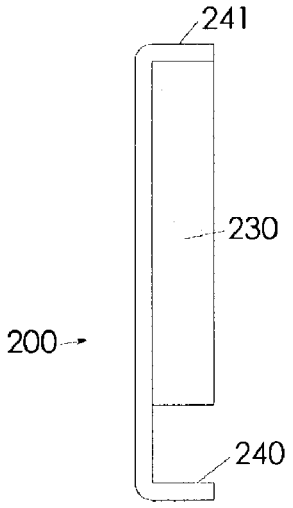
Figure 17D:
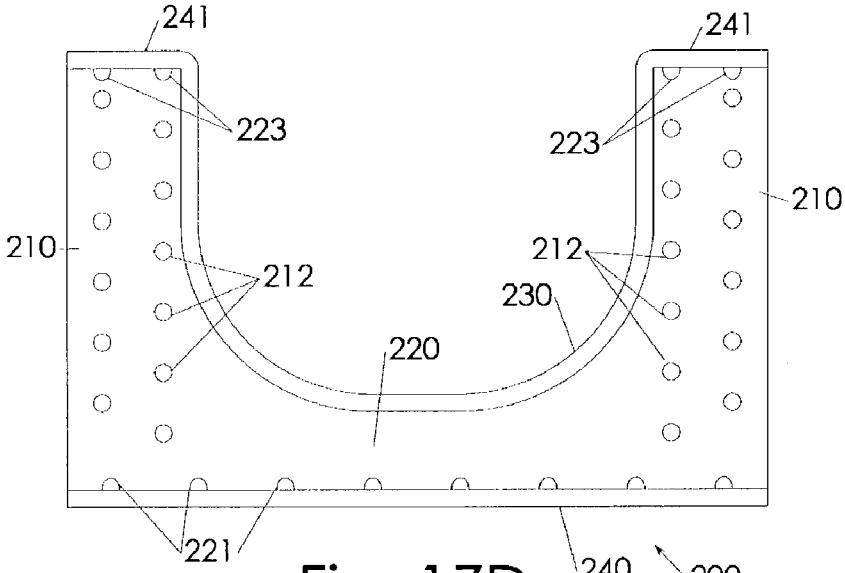

In FIG. 7, a fourth of the preferred embodiments is illustrated in which the third stiffening ribs 150 feature second flanges 152, which on one hand increase the stiffness of the third stiffening rib 150 and on the other hand provide for an additional area contact between the third stiffening ribs 150 and the web 3. FIG. 7 shows an additional support device 100 of the fourth embodiment in a second assembly position on the opposite side of the web 3. In that fashion maximum buckling opposing support may be provided from both sides to the web 3. Opposing contact pressure in the buckling opposing interfaces holds thereby the web 3. The opposing contact pressure may be applied by fasteners holding together two opposing flanges 132 and/or 152 through the web 3. The dual assembly position of FIG. 7 is not limited to a particular embodiment of the support structure 100. A support device 100 in accordance with the fourth embodiment is shown in top view in FIG. 14A, in perspective view in FIG. 14B, in side view which is in protrusion direction of the I-joist 1 in FIG. 14C, and in FIG. 14D in front view, which is in direction of the reference plane 11. The flanges 132 and 152 may also feature primary attachment holes 112 for a direct attachment to the web 3.

In the first, second, third and fourth embodiments, the main planar body of the support device 100 is placed immediately adjacent the reference plane 11. The stiffening ribs 130, 140, 150 point towards the web 3 in assembled position. The buckling opposing interface is defined either by attachment of the bridging structures' 110 planar portions to the web 3 via the support structure 20 and/or by attachment of the flanges 132 and/or 152 to the web 3.

In the fifth, sixth, seventh, eights, ninth, tenth and eleventh embodiments described in the below under FIGS. 8–10 and FIGS. 15–21, the support device 200 is configured for a direct contact of the main planar body portion with the web 3. In assembly position of the support device 200, the stiffening ribs 230, 240, 250, 260, 270 protrude away from the web 3. The buckling opposing interface is defined primarily by attachment of the bridging structures' 110 planar portions directly to the web 3.

Whereas the first, second, third and fourth embodiments are configured for preferably including the support structure 20, the fifth, sixth, seventh, eights, ninth, tenth and eleventh embodiments are specifically configured to provide a buckling opposing interface without use of the additional support structure 20. The fifth, sixth, seventh, eights, ninth, tenth and eleventh embodiments provide for a splicing opposing connection of the support device 200 in a corner line 12 along a boundary between web 3 and either of the chords 2, 4.

Figure 8A:
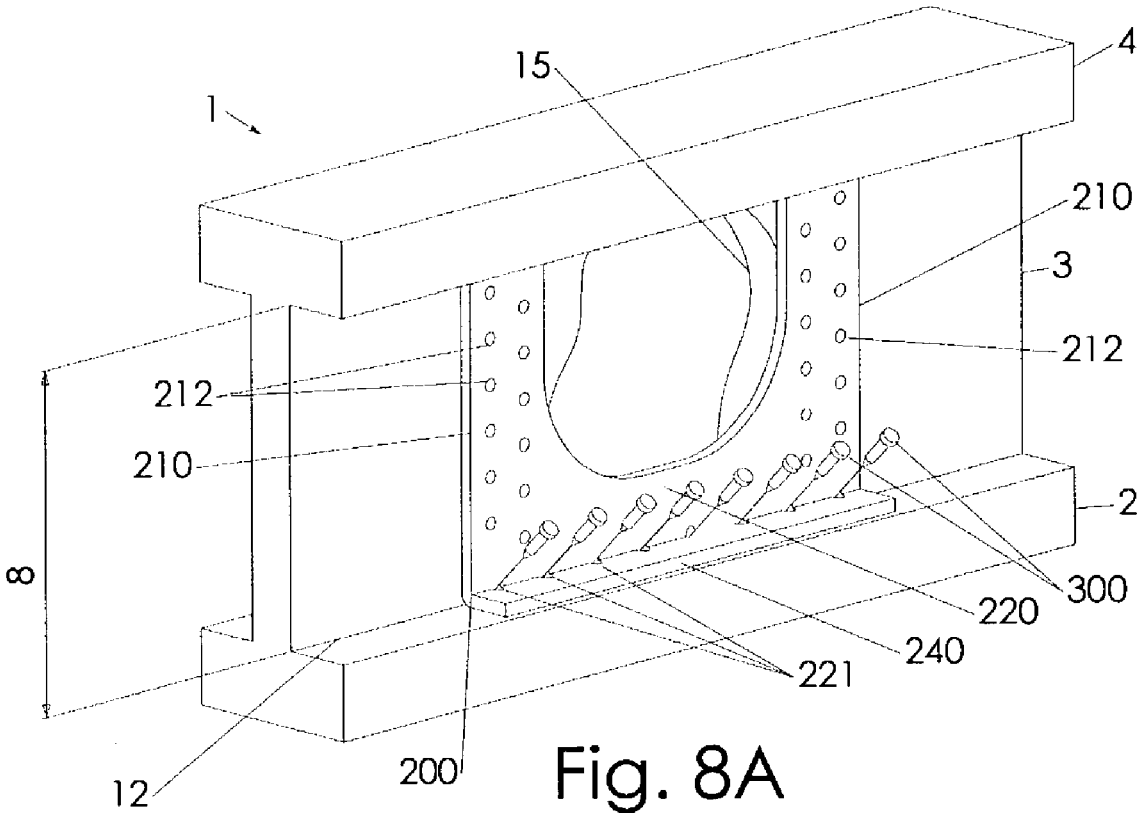
FIGS. 8A, 8B depict a fifth embodiment in perspective view and in front view in protrusion direction of the I-joist.
Figure 8B:
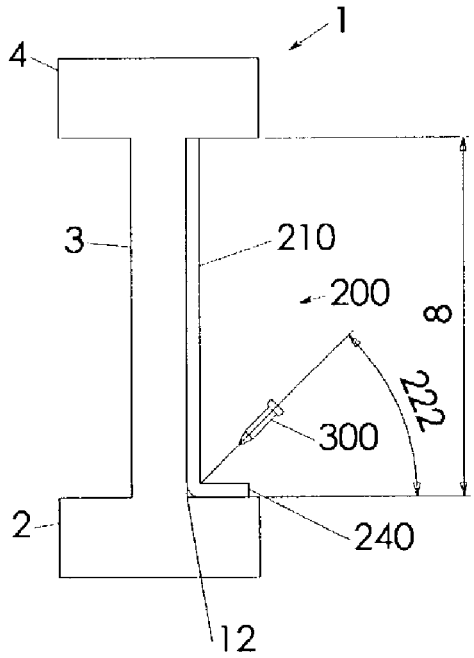

The fifth embodiment of the invention is shown in assembled position in FIGS. 8A and 8B. The main planar body of the support device 200 contacts one side of the web 3 along the web height 8. A horizontally oriented spacing structure 220 combines and holds the two bridging structures 210 in a predetermined clearance distance as is described for the first, second, third and fourth embodiments. Primary attachment holes 212 are placed along the protrusion direction of the bridging structures 212 for a direct attachment of the bridging structures 212 to the web 3.

A fourth primary stiffening rib 240 spans across the two bridging structures 210. The fourth primary stiffening rib 240 may be interrupted or continuous as is exemplarily depicted in the Figures. The fourth primary stiffening rib 240 is substantially perpendicular to the main planar body. The fourth primary stiffening rib 240 is positioned on the support device 200 such that it snuggly contacts in assembly position the lateral inside portion of at least one of the chords 2, 4, while the bridging structures 210 are oriented across the web 3.

The support device 200 further features angulated holes 221 protruding through and positioned in a fold between the main planar body and the fourth primary stiffening rib 240. In that way, the said support device 200 may be attached with fastener 300 along an angle 222 through the angulated holes 221 to the I-joist 1. In assembled position where the main planar body snuggly contacts the web 3 and where the fourth primary stiffening rib 240 snuggly contacts the inside of one of the chords 2, 4, the angulated holes 221 point directly onto a corner line 12. Corner lines 12 exist along the boundaries between the web 3 and the chords 2, 4.

The corner line 12 provides thereby for a centering of the fasteners 300 avoiding a slipping of them along a surface of the I-joist 1 prior to surface penetration. In addition, the angular penetration of the fasteners 300 along the corner line 12 keeps a splicing risk of the chord(s) 2, 4 to a minimum. Also, the angular fastening direction provides for an easy access of the fasteners during their placement.

Further, the angular fastening direction provides for a simultaneous contact pressure of the main planar body and the fourth primary stiffening rib 240 with the opposing surfaces of the I-joist 1. Hence, by initially attaching the support device 200 on the I-joist 1 via the fasteners 300 and through the angular holes 221, the support device is brought into a tight, snuggle contact position with both the web 3 and one the bottom chord 2. In case the support device 200 is attached with the spacing structure 220 above the hole 15, the fourth stiffening 240 snuggly contacts the top chord 4.

The bridging structures 210 are directly attached to the web 3 via primary attachment holes 212. The bridging structures 210 operate similar like bridging structures 110 except that they provide the buckling opposing interface with the remainder of the web 3 without inclusion of the support structure 20. A support device 200 in accordance with the fifth embodiment is shown in top view in FIG. 15A, in perspective view in FIG. 15B, in side view which is in protrusion direction of the I-joist 1 in FIG. 15C, and in FIG. 15D in front view, which is in direction of the reference plane 11.

Figure 9A:
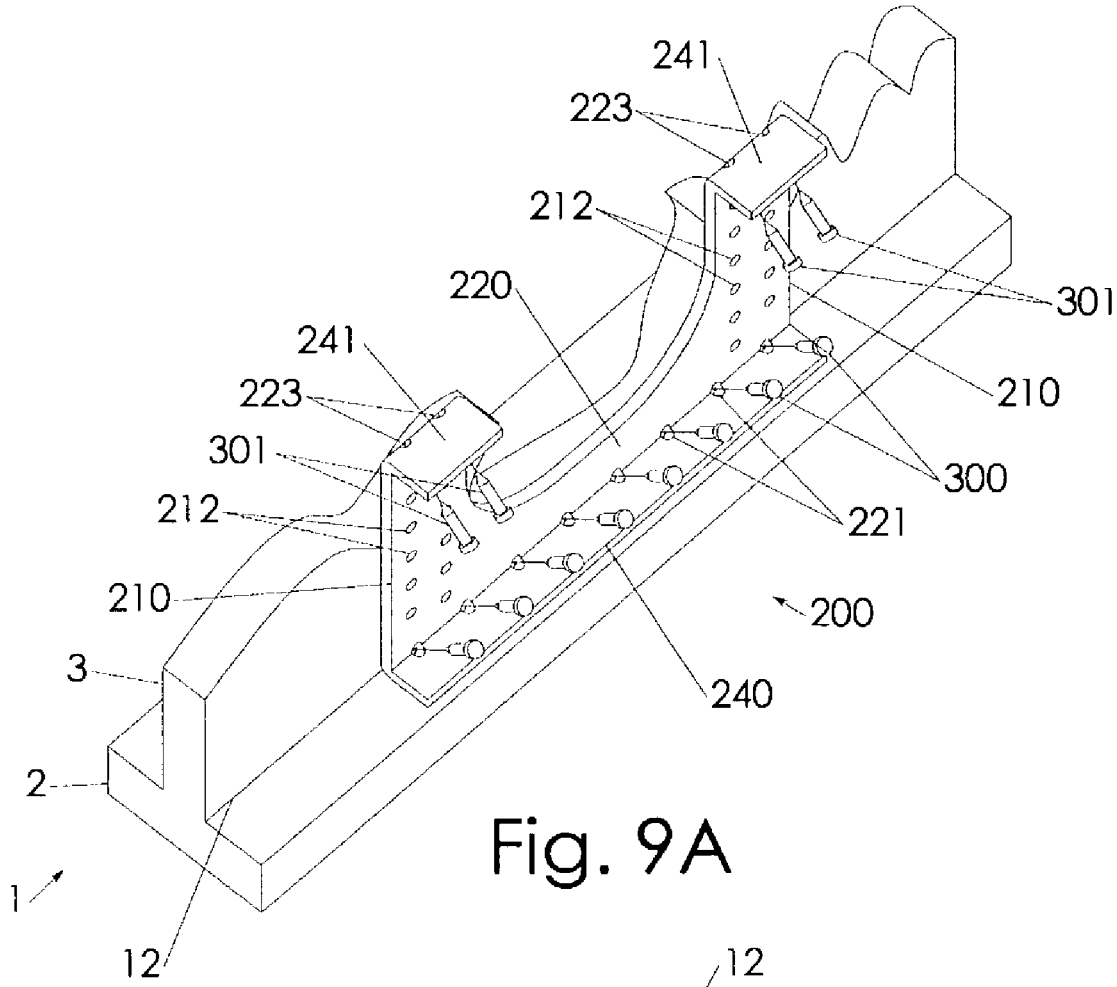
FIGS. 9A, 9B depict a sixth embodiment in perspective view and in front view in protrusion direction of the I-joist.
Figure 9B:
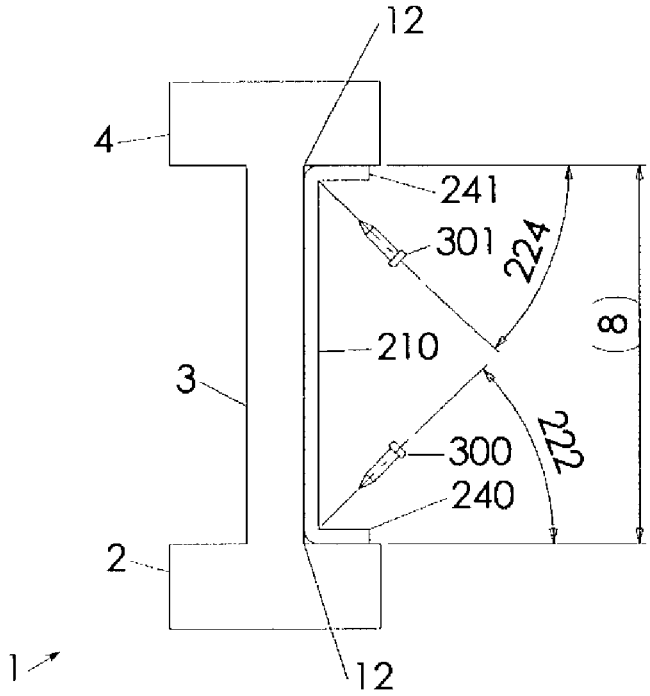

FIGS. 9A and 9B illustrate a sixth embodiment in which secondary fourth stiffening ribs 241 span across the bridging structures 210 opposite the fourth primary stiffening rib 240. Angular holes 223 protrude through the fold between secondary fourth stiffening rib 241 and the bridging structures 210 in an angle 224. Fasteners 301 may be attached in a fashion similar as described in the above for the angular holes 221 and the fasteners 300.

A height of the support device 200 is selected in correspondence with varying dimensional standards of the web height 8. Consequently, fourth stiffening ribs 240, 241 snuggly contacting both chords 2, 4 and provide for an direct transmission of an eventual compressive force between the chords 2, 4 resulting from a load carrying deflection of the I-joist 1. The web 3 may be consequently supported and/or relieved from compressive peak loads, which additionally reduces the web's 3 buckling tendency. A support device 200 in accordance with the sixth embodiment is shown in top view in FIG. 16A, in perspective view in FIG. 16B, in side view which is in protrusion direction of the I-joist 1 in FIG. 16C, and in FIG. 16D in front view, which is in direction of the reference plane 11.

Figure 10A:
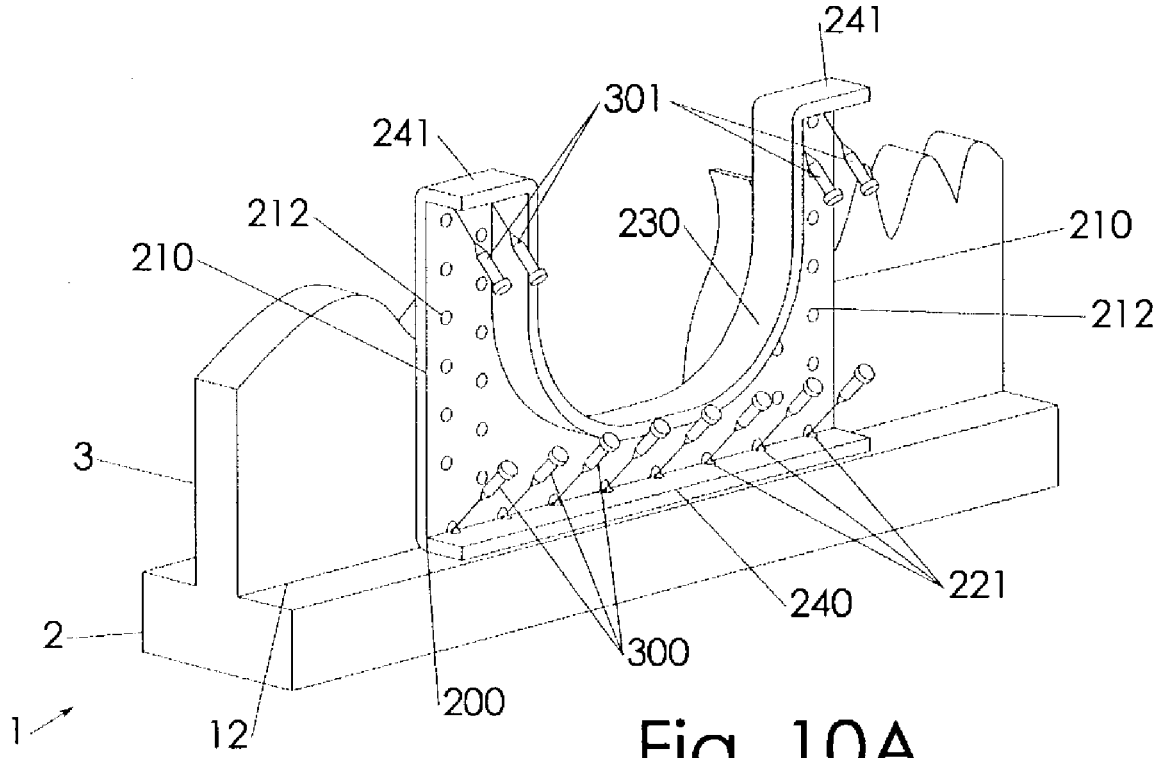
FIGS. 10A, 10B depict a seventh embodiment in perspective view and in front view in protrusion direction of the I-joist.
Figure 10B:
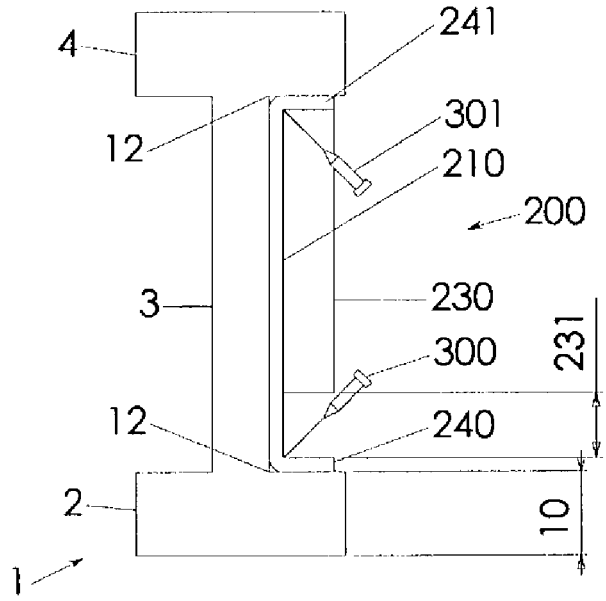

FIGS. 10A and 10B show a seventh embodiment in which a fifth stiffening rib 230 protrudes along the inside U-shaped edge of the support device 200. The fifth stiffening rib 230 protrudes perpendicular from the main planar body in direction of either of the fourth stiffening ribs 240, 241. In case, the support device 200 features a fourth secondary stiffening rib 241, the fifth stiffening rib 230 may be fully, partially or not directly connected to the rib 241. The fifth stiffening rib 230 may have flaps extending at its ends (not shown). The flaps may be bent into an orientation parallel to the rib(s) 240 as is well known for enforcing three plane-corner regions of folded sheet metal parts.

An offset 231 between the horizontal portion of the fifth stiffening rib 230 and the fourth primary rib 240 may correspond to the chord height 10. In that fashion, the support device 200 may be assembled with the main planar body being coplanar to the reference plane 11 and with the stiffening ribs 230, 240 or 241 pointing towards the web 3; the spacing structure 220 may operate thereby similar to the chord embedding structure 120. A support device 200 in accordance with the seventh embodiment is shown in top view in FIG. 17A, in perspective view in FIG. 17B, in side view which is in protrusion direction of the I-joist 1 in FIG. 17C, and in FIG. 17D in front view, which is in direction of the reference plane 11.

Figure 18A:
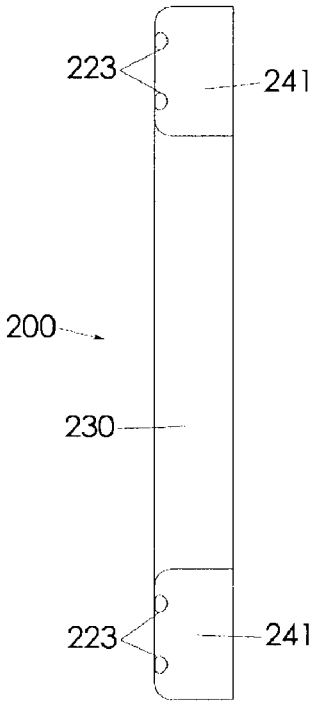
FIGS. 18A–18D illustrate various views of the support device in accordance with the eighth embodiment of the invention.
Figure 18B:
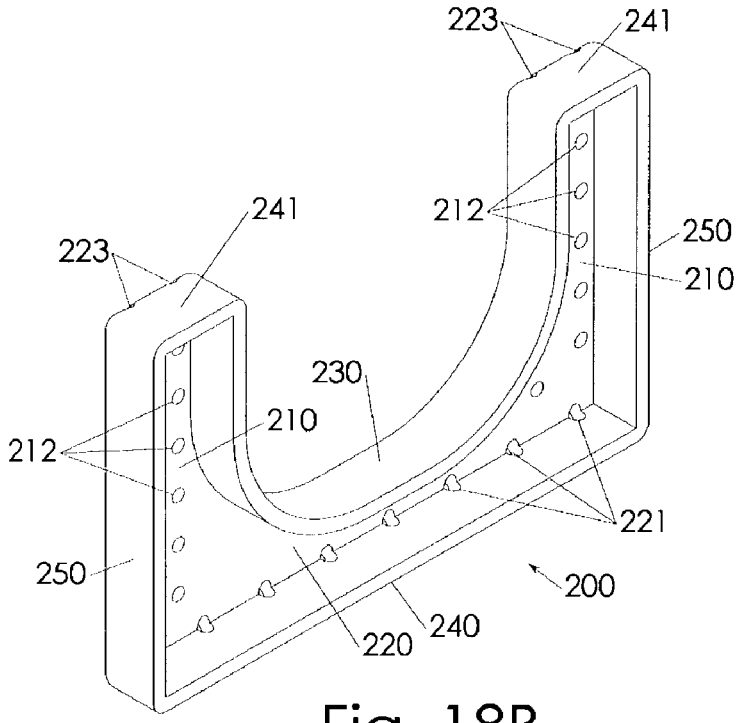
Figure 18C:
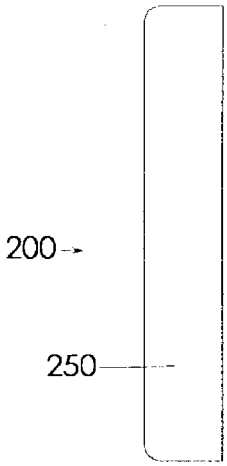
Figure 18D:
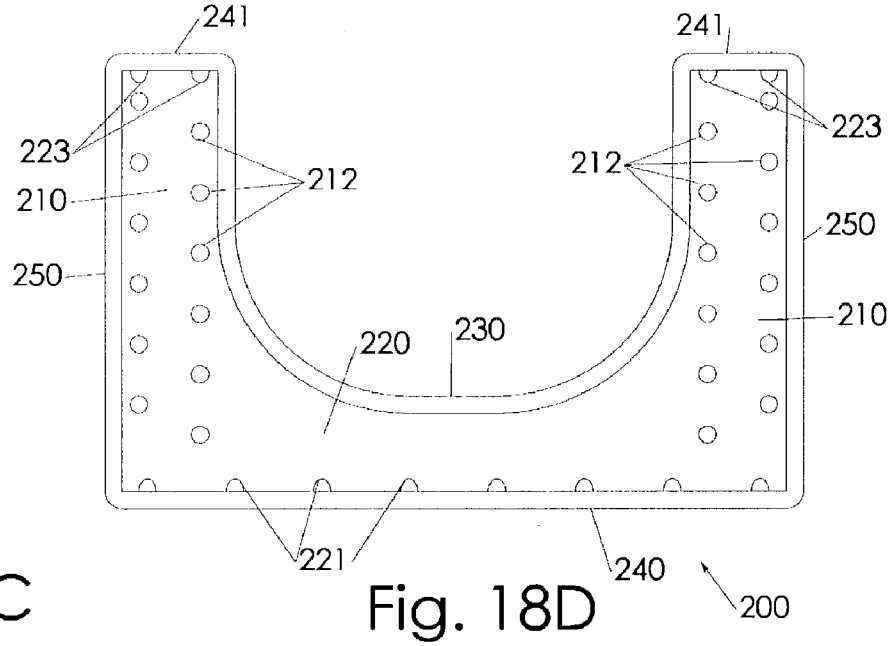

A support device 200 in accordance with an eight embodiment is shown in top view in FIG. 18A, in perspective view in FIG. 18B, in side view which is in protrusion direction of the I-joist 1 in FIG. 18C, and in FIG. 18D in front view, which is in direction of the reference plane 11. In the eight embodiment, the support device 200 features sixth stiffening ribs 250 that protrude from the outside edges of the bridging structures 210 perpendicular from the main planar body in direction of either of the fourth stiffening ribs 240, 241. The sixth stiffening ribs 250 may be fully, partially or not connected to either or both of the stiffening ribs 240, 241. The sixth stiffening ribs 250 may have flaps extending at either or both of its ends. The flaps may be bent into an orientation parallel to the rib(s) 240, 241 as is well known for enforcing three-plane corner regions of folded sheet metal parts.

Figure 19A:
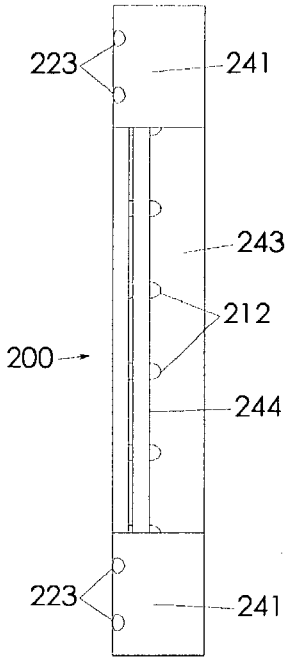
FIGS. 19A–19D illustrate various views of the support device in accordance with the ninth embodiment of the invention.
Figure 19B:
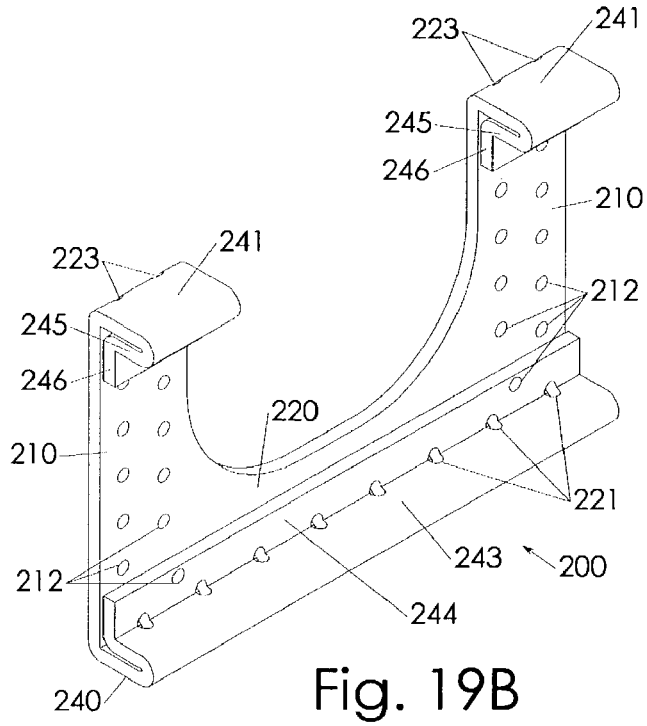
Figure 19C:
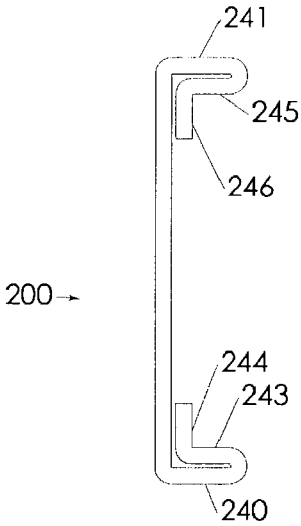
Figure 19D:
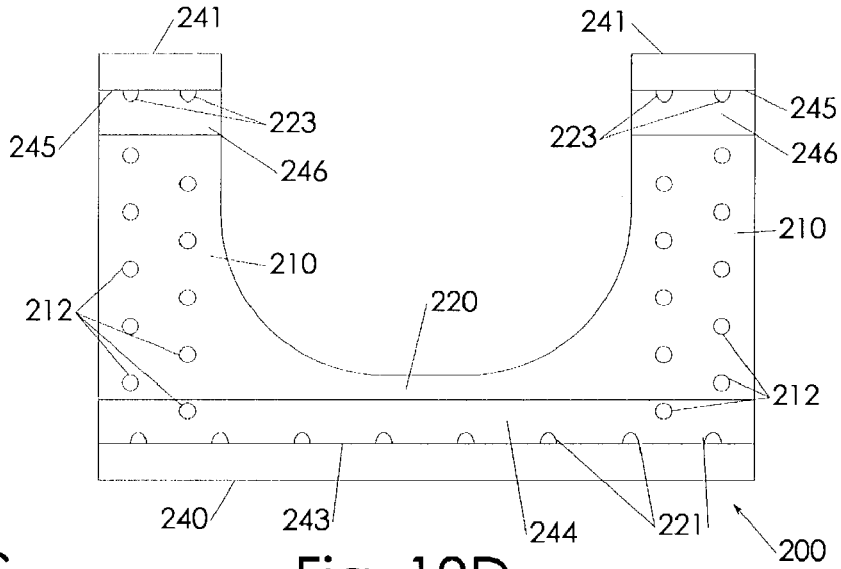

A support device 200 in accordance with a ninth embodiment is shown in top view in FIG. 19A, in perspective view in FIG. 19B, in side view which is in protrusion direction of the I-joist 1 in FIG. 19C, and in FIG. 19D in front view, which is in direction of the reference plane 11. In the ninth embodiment, the fourth horizontal stiffening ribs 240, 241 include a back folded support angle featuring first wings 243, 245 and second wings 244, 246. First wings 243, 245 are continuations of the fourth stiffening ribs 240, 241 that are bent backwards at their peripheral ends and brought into substantially parallel orientation. The second wings 244, 246 are parallel to the main planar body. The angulated holes 221, 223 protrude all the way through the support angles. The support angles substantially increase a bending stiffness of said fourth stiffening ribs 240, 241 as may be well appreciated by anyone skilled in the art.

Figure 20A:
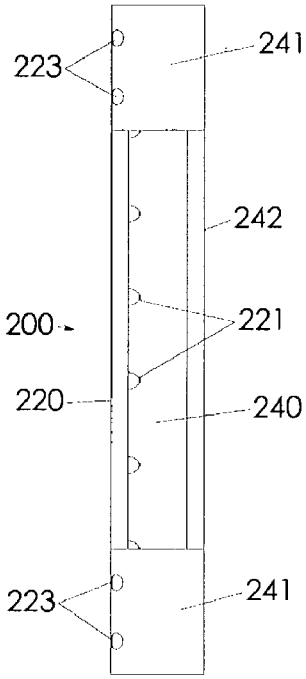
FIGS. 20A–20D illustrate various views of the support device in accordance with the tenth embodiment of the invention.
Figure 20B:
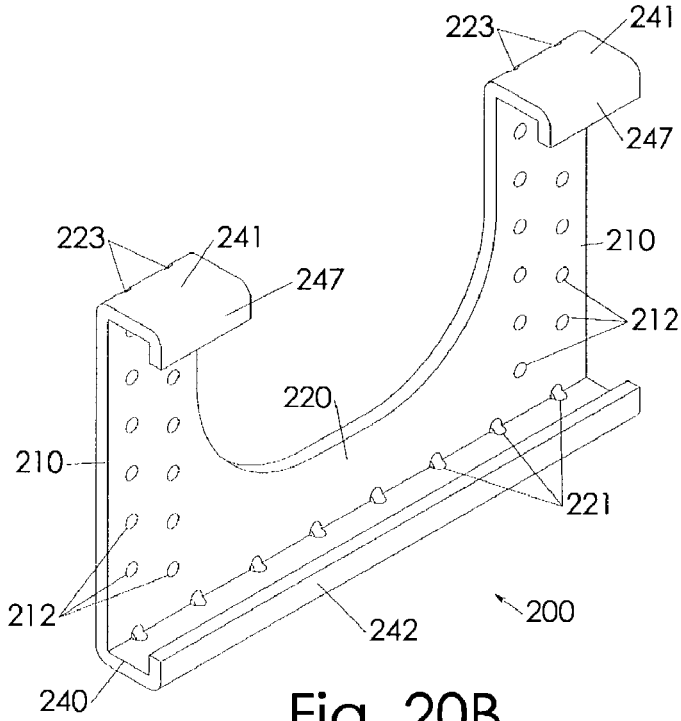
Figure 20C:
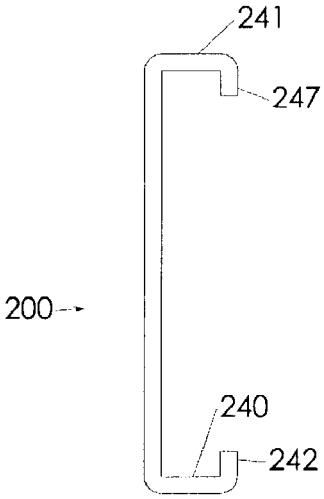
Figure 20D:
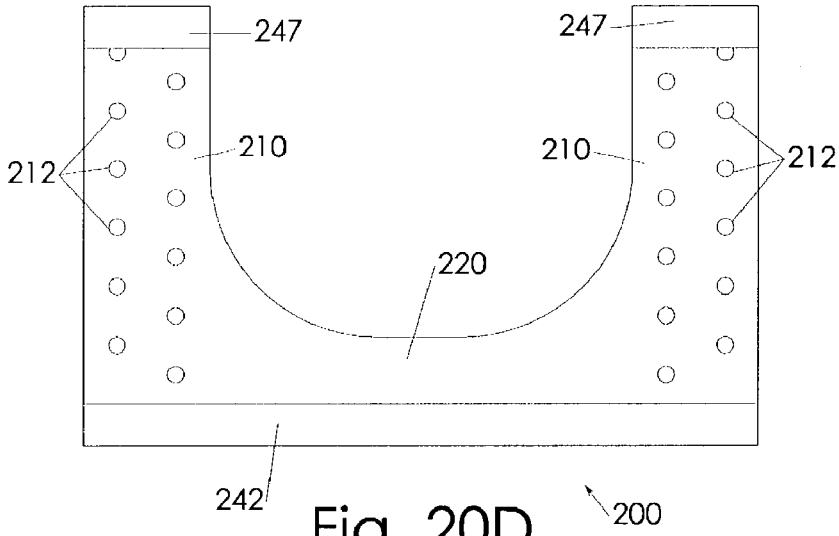

A support device 200 in accordance with a tenth embodiment is shown in top view in FIG. 20A, in perspective view in FIG. 20B, in side view which is in protrusion direction of the I-joist 1 in FIG. 20C, and in FIG. 20D in front view, which is in direction of the reference plane 11. In the tenth embodiment, the fourth stiffening ribs 240, 241 feature at their peripheral ends stiffening flanges 242, 247. Similarly, fifth and sixth stiffening ribs 230, 250 may also feature stiffening flanges (not shown). The stiffening flanges 242, 247 provide additional buckling stiffness to the ribs from which they extend.

Also, the stiffening flanges 242, 247 may be bent opposite to the direction indicated in the FIGS. 20A–20D. In that fashion, the stiffening flanges 242, 247 may wrap around the chord(s) 2, 4. Eventual additional flanges (not shown) may be provided at the peripheral ends of the stiffening flanges 242, 247 such that the chord(s) 2, 4 is/are embraced from three sides by sheet metal.

Figure 21A:
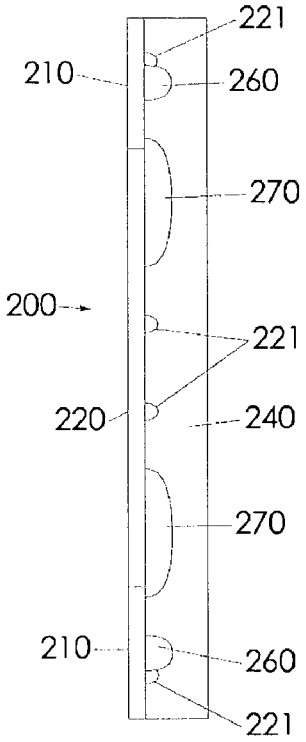
FIGS. 21A–21D illustrate various views of the support device in accordance with the eleventh embodiment of the invention
Figure 21B:
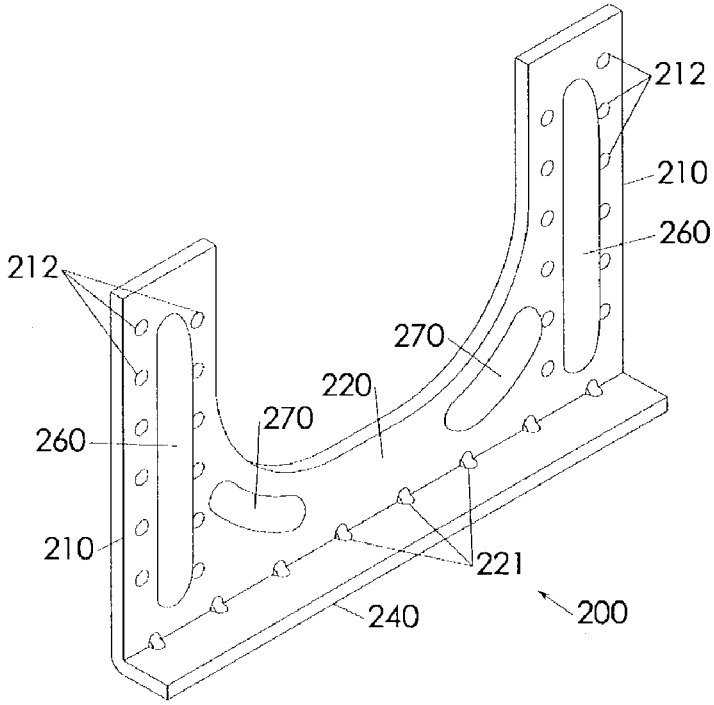
Figure 21C:
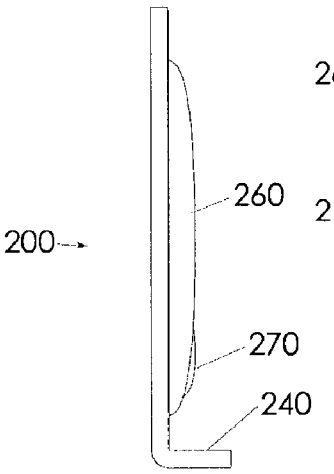
Figure 21D:
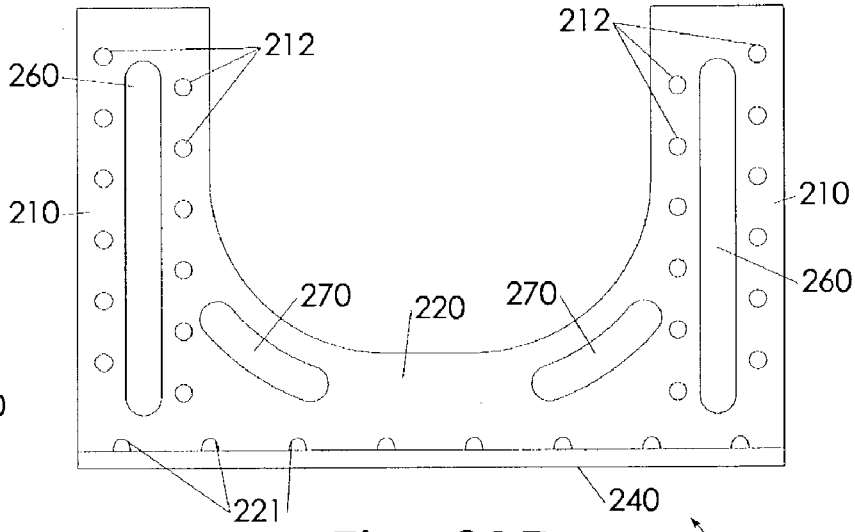

Finally, a support device 200 in accordance with an eleventh embodiment is shown in top view in FIG. 21A, in perspective view in FIG. 21B, in side view which is in protrusion direction of the I-joist 1 in FIG. 21C, and in FIG. 21D in front view, which is in direction of the reference plane 11. In the eleventh embodiment, the support device 200 features seventh stiffening ribs 260, 270 indented in the main planar body.

A practical test of a wooden I-joist, commercially available under the specification 9½" LPI 200 with a maximal shear load of 1125 lb under standardized conditions was reinforced by a single support device 200 according to the seventh embodiment made from 16 gage standard sheet metal. A hole was cut into the web portion of the tested I-joist. The cut hole extended in vertical direction from top chord to bottom chord and in horizontal direction from side to side up to the vertical portions of the inside U-shaped contour of the support device 200. The practical test resulted in tested failure load of 2370 lb.

The support devices 100, 200 are preferably monolithically fabricated from sheet metal by bending, deep drawing, hydro forming and/or other well-known sheet metal forming operations.

The scope of the invention includes embodiments in which the two bridging structures 110 are combined by two opposing chord embedding structures 120 and/or in which the two bridging structures 210 are combined by two opposing spacing structures 220. In that cases, the outside contour of the support devices 100, 200 in view onto the reference plane 11 is approximately that of a square. The inside contour has thereby an approximately O-shape. In that cases, stiffening ribs 130, 230 follow the O-shape contour.

The scope of the invention includes embodiments, in which more than two bridging structures 110, 210 are combined by alternately arrayed structures 120, 220.

The support device 100 may be provided as a repair means for erroneously cut holes 15. The support device 100 may also be configured for providing a cutting mask to prevent erroneously hole cutting.

The support devices 100, 200 may be part of an originally fabricated I-joist 1 for the purpose of providing increased buckling resistance and/or bending resistance at a given section of the I-joist 1. This may be particularly advantageous, where it is desirable to keep the all over dimensions of an I-joist 1 to a minimum regardless an eventual peak load at identified sections of the I-joist 1.

Finally, the support devices 100, 200 may also be configured in combination with other I-beams and/or I-shaped profiles such as metal I-beams. In such configurations, the attachment features may be designed in well-known fashion and in conjunction to well-known particularities of the corresponding I-beams. In the exemplary case of a metal I-beam, the bridging structures 110, 210 may be attached to the chords 2, 4 by welding.

What is claimed is:

1. A support device for a buckling opposing support of a web portion between a top chord and a bottom chord of an I-joist, said support device comprising:

a. at least two bridging structures each separately defining a buckling opposing interface with said web portion and across a web height of said web portion in an assembled position in which said bridging structure is attached to said web portion;

b. a spacing structure for combining and holding said bridging structures;

wherein said I-joist is made from a material selected from a group consisting of wood and wood like materials; and wherein at least one of said bridging structures provides at least one of:

ii. a vertical portion of a stiffening rib protruding from an inside contour of said support device, iii. a stiffening rib protruding from a vertical outer edge of at least one of said bridging structures;

iv. a stiffening rib vertically indented in a main planar body of at least one of said bridging structures;

such that said bridging structure has increased bending resistance and the buckling opposing interface is stiffened, both to the extend that a buckling tendency of said web portion at an assembly location of said support device on said I-joist remains within predetermined safety limits irrespective an eventually erroneously hole cut into said web portion at said assembly location;

the support device is configured such that in said assembled position a main planar body of said support device is immediately adjacent said web portion, said support further comprising:

(a) a horizontal stiffening rib horizontally spanning across said at least two bridging structures, said horizontal stiffening rib being substantially perpendicular to said main planar body and wherein said horizontal stiffening rib is positioned on said support device such that said horizontal stiffening rib snuggly contacts in said assembly position a lateral inside portion of at least one of said chords while the bridging structures are oriented across said web; and (b) an angulated hole protruding through and positioned in a fold between said main planar body and the horizontal stiffening rib such that said support device may be attached in an angulated fashion with a fastener through said angulated hole to said I-joist in a corner line along a boundary between said web and at least one of said chords.

2. The support device at claim 1, wherein said budging structure features primary holes for laterally attaching said bridging structure with fasteners to said web portion.

3. The support device of claim 1, wherein pair of said horizontal stiffening rib is positioned at opposing ends of said bridging structures such that each at said pair of said fourth stiffening rib snuggly contact one opposing of two of said lateral inside portion.

4. The support device at claim 1, wherein said horizontal stiffening rib includes a back folded support angle such that a bending stiffness of said fourth stiffening rib is substantially increases, and wherein said angulated hole protrudes through said support angle.

5. The support device of claim 1, wherein said spacing structure said holds said bridging structures in a clearance distance selected in conjunction with a maximum safety diameter far a hole cut into said web portion.

6. The support device of claim 1, wherein two of said at least two bridging structures end one of said spacing structure define an approximate U-shape.

7. The support device of claim 1, wherein said bridging structure comprises primary holes arrayed slang said planar portion of said bridging structure for directly attaching said bridging structure with fasteners to said web.

8. The support device of claim 1 being monolithically fabricated from sheet metal.

* * * * *